US005692941A

United States Patent [19]

Takeda et al.

[11] Patent Number: 5,692,941

[45] Date of Patent: Dec. 2, 1997

[54] METHOD OF AND APPARATUS FOR WELDING SPRING TO APERTURE GRILL

[75] Inventors: Masami Takeda; Tomoyuki Kurihara; Kazuhiko Otsuka, all of Aichi; Yoshirou Kojima, Gifu, all of Japan

[73] Assignee: Sony Corporation, Tokyo, Japan

[21] Appl. No.: 617,900

[22] PCT Filed: Jul. 18, 1995

[86] PCT No.: PCT/JP95/01421

§ 371 Date: May 7, 1996

§ 102(e) Date: May 7, 1996

[87] PCT Pub. No.: WO96/02930

PCT Pub. Date: Feb. 1, 1996

[30] Foreign Application Priority Data

Jul. 18, 1994 [JP] Japan ..... 6-188794

[51] Int. Cl.[6] ..... H01J 9/18; H01J 9/42

[52] U.S. Cl. ..... 445/3; 445/30; 445/63; 445/68

[58] Field of Search ..... 445/29, 30, 68, 445/3, 63

[56] References Cited

U.S. PATENT DOCUMENTS 4,164,060 8/1979 Hartta ..... 445/30

4,356,606 11/1982 Dougherty et al. ..... 445/30

4,451,243 5/1984 D'Augustine et al. ..... 445/30

FOREIGN PATENT DOCUMENTS 55-1089 1/1980 Japan ..... 445/30

*Primary Examiner*—P. Austin Bradley

*Assistant Examiner*—Jeffrey T. Knapp

*Attorney, Agent, or Firm*—Hill, Steadman & Simpson

[57] ABSTRACT

When three or four panel attachment springs 3 are welded to side portions of an aperture grill 1 (or 21), the aperture grill is disposed so that a grill 107 should be opposed to a predetermined reference plane. The springs are disposed by three or four spring positioning means. A posture of the aperture grill 1 (or 21) is adjusted based on measured results of the respective measurement position $Z_0$ to $Z_4$ of the grill 107. Positions of spring pins for supporting springs on the spring positioning means are agreed with positions of panel pins provided on a panel. Thereafter, the respective springs are simultaneously welded to the side portions of the aperture grill. Thus, it is possible to precisely weld the springs to side-portion positions of the aperture grill. When the four springs are welded, it is possible to simultaneously weld the four springs by one equipment.

12 Claims, 18 Drawing Sheets

METHOD OF AND APPARATUS FOR WELDING SPRING TO APERTURE GRILL

TECHNICAL FIELD

The present invention relates to a method of and an apparatus for welding a panel attachment spring to an aperture grill forming a color cathode-ray tube (hereinafter simply referred to as a CRT).

BACKGROUND ART

In a CRT employing an aperture grill as a color selection mechanism for use in a television receiver and a monitor television receiver of a computer, an aperture grill with a large number of slits formed therethrough is attached to an inside of a panel coated on its inner surface with fluorescent paints of three primary colors (R, G, B). Three primary color electron beams emitted from an electron gun pass through the slits of the aperture grill and are radiated on fluorescent paint portions of corresponding colors on the inner surface of the panel.

The above aperture grill includes a substantially rectangular frame formed of four members of upper, lower, left and right members, and a grill stretched between the upper and lower members. A large number of the above-mentioned slits are formed through the grill extended vertically at portions with intervals from its left and right.

The above panel includes a substantially rectangular panel portion coated on its inner surface with the above fluorescent paints and four skirt portions of upper, lower, left and right skirt portions, projectingly formed so as to be extended from four sides of the panel portion toward the inside of the tube. The panel portion is formed so as to have a little larger size as compared with the above grill.

The above aperture grill is attached to the panel by engaging pin apertures of panel attachment springs welded to the three or four members of the aperture grill with pins (so-called panel pins) fitted to inner surfaces of the three or four skirt portions of the panel.

If an interval between a grill surface and the inner surface of the panel portion is different from a design value in a state that the aperture grill is attached to the panel as described above, then the electron beams passed through the slits of the grill are not accurately radiated on the corresponding fluorescent paint portions of the panel portion, which leads to defects of an assembled CRT such as an erroneous landing of beams or the like.

Therefore, it is important to accurately set particularly the interval at any portion between the grill surface and the inner surface of the panel portion to the design value at any places in a CRT requiring high definition such as the monitor television receiver of the computer, a CRT having a large screen size and so on. For this end, it is necessary to accurately position the pin aperture of the spring relative to the grill.

In the prior art, there is increased an accuracy of a position where the springs are welded to the respective members of the above frame.

However, it is sometimes observed that the above frame is twisted by strains of its respective members or the like. In this case, the grill is twisted similarly to the frame. Accordingly, even if the accuracy of the spring welded positions relative to the respective members is increased, the positions of the pin apertures of the springs relative to the grill are displaced because of the twisted grill. This positional displacement prevents the interval between the grill surface and the inner surface of the pane portion in the state that the aperture grill is attached to the panel, from deviating from the design value at some places. Therefore, defects such as the erroneous landing of the beams or the like cannot be prevented surely.

Since the springs are welded to the respective members in consideration of only the positional accuracy of the spring relative to each of the members in the prior art, it is not known before the welding of the springs whether or not positions of the pins of the respective springs are set to positions where the interval (a so-called grill height GH) between the grill surface and the inner surface of the panel portion in the state that the aperture grill is attached to the panel is always set to the design value at any place. Only after the springs are welded, it was possible to confirm the accuracy by measuring the interval between the grill surface and the inner surface of the panel after the aperture grill was practically attached to the panel.

Accordingly, there tend to be produced a large number of unsatisfactory aperture grills in which the springs are welded to the member positions which cause deviation of the intervals between the grill surface and the inner surface of the panel portions from the design value at some portions. This results in demerit of unsatisfactory yield.

The aperture grill of the high-definition CRT is attached to the panel through four springs welded to the four members of the upper, lower, left, and right members. When the four springs are welded, two assembly accuracies in an interval GH marriage and an engagement marriage are required. The interval GH marriage is to set the interval GH between the panel and the aperture grill which are to be assembled to the standard size. The engagement marriage is to agree the positions of the pin apertures of the four springs welded to the aperture grill with the positions of the four pins provided on the panel.

The four springs have been welded in the following manner. The aperture grill is positioned with reference to the positions of the three springs of the first, second, and third springs, so that the interval GH should be set to the standard size. The first, second and third springs are welded. Thus, the interval GH marriage is finished. Subsequently, the positions of the pins of the panel to be assembled with the aperture grill are transferred to reference pins provided on a welding machine. The aperture grill is positioned by the first, second and third springs, and then a fourth spring is welded. Thus, the engagement marriage is finished.

As described above, the prior art employs two spring welding processes for the interval GH marriage and the engagement marriage. Therefore, requirement of a plurality of equipments leads to unsatisfactory efficiency in a space of the equipments.

The present invention is proposed in view of such aspects. An object of the present invention is to provide a method of and an apparatus for welding a spring to an aperture grill which allow the spring for attaching the panel to be accurately welded to the side-portion positions of the aperture grill in correspondence with the respective grills so that the electron beams passed through the grill should be accurately radiated on the corresponding fluorescent paint positions of the panel portion in the assembled CRT.

Another object of the present invention is to provide the method of and the apparatus for welding the spring to the aperture grill which, when the four springs are welded to the aperture grill, allow the four springs to be simultaneously welded by one equipment.

DISCLOSURE OF THE INVENTION

According to the present invention, when panel attachment springs are welded to at least three side portions of four side portions of a substantially rectangular aperture grill having a color selection grill, the aperture grill is disposed so that the grill should be opposed to a predetermined reference plane. The springs are disposed at positions opposed to the at least three side portions outside the aperture grill on an upper plane in parallel to the reference plane. Positions of a plurality of measurement positions of the grill relative to the reference plane are measured. A posture of the aperture grill is adjusted based on measured results of the respective measurement positions of the grill so that the respective measurement positions should be located at predetermined reference positions relative to the reference plane. After the posture of the aperture grill is adjusted, the springs are moved close to the aperture grill on the plane in parallel to the reference plane, brought in contact with the above-mentioned at least three side portions, and welded to the three side portions.

Also, according to the present invention, three supporting bodies respectively support one side portion of a pair of the above-mentioned side portions opposed to each other at a middle-side portion position in the extended direction of the above-mentioned side portion and the other side portion at two side-portion positions located at an interval in the extended direction of the side portions. The respective supporting bodies are moved in the direction in which they are moved close to and away from the respective side portions. Thus, the posture of the aperture grill is adjusted.

Further, according to the present invention, the measurement of the positions of a plurality of measurement positions of the grill with respect to the reference plane and the welding of the springs to the at least three side portions are respectively carried out at positions located at an interval along the reference plane.

Also, according to the present invention, a spring welding apparatus is an apparatus for welding the panel attachment springs to the at least three side portions of the four side portions of the substantially rectangular aperture grill having the color selection grill, and includes a table, an aperture-grill supporting means for supporting the aperture grill on the table so that a posture of the aperture grill can be adjusted, a grill-position measuring means for measuring the positions of the plurality of measurement positions of the grill in a state that the aperture-grill supporting means supports the aperture grill, an aperture-grill posture adjusting means for driving the aperture-grill supporting means based on results obtained by measurement of the grill-position measuring means and for adjusting the posture of the aperture grill so that the plurality of measurement positions of the grill should be located at respective predetermined positions, an aperture-grill positioning means for positioning on the table the aperture grill adjusted in posture by the aperture-grill posture adjusting means, a spring positioning means respectively disposed at positions opposed to the at least three side portions of the aperture grill positioned by the aperture-grill positioning means, for bringing the springs in contact with the at least three side portions to position the springs, and a spring welding means for welding the springs positioned by the spring positioning means to the side portions of the aperture grill positioned by the aperture-grill positioning means.

Further, according to the present invention, the aperture-grill supporting means includes three supporting bodies which are provided in the table so that they can be lifted up and down, for respectively supporting one side portion of the above-mentioned side portions which are opposed to each other, at a middle side-portion position in the extended direction of the side portion and the other side portions located at an interval in the extended direction of the side portion at the two side-portion positions. The aperture-grill posture adjusting means includes lifting and driving sources for lifting the respective supporting bodies up and down.

Also, according to the present invention, the aperture-grill supporting means, the grill-position measuring means, the aperture-grill posture adjusting means, the aperture-grill positioning means, and the spring positioning means are provided in the table.

According to the present invention, there are further provided spring supplying means for supplying the springs to the respective spring positioning means.

According to the present invention, there are further provided a base mount for movably supporting the table and a table drive means for moving the table on the base mount. The measurement of the positions of the plurality of measurement positions of the grill by the grill-position measuring means, the supply of the springs to the respective spring positioning means by the spring supplying means, and the welding of the springs to the aperture grill by the spring welding means are carried out in a state that the table are moved to different positions on the base mount.

According to the present invention, the side portion of the aperture grill includes four members of upper, lower, left and right members. Spring holders are attached to at least three members of the above-mentioned four members. The spring welding means welds the springs to the spring holders.

According to the present invention, when the panel attachment springs are welded to four side portions of the substantially rectangular aperture grill having the color selection grill, the springs are disposed at respective spring pins of the four spring positioning means for positioning the springs. The aperture grill is disposed so that the grill should be opposed to the reference plane determined by the spring pins of the three spring positioning means of the four spring positioning means. The positions of the plurality of measurement positions of the grill relative to the reference plane are measured. The posture of the aperture grill is adjusted based on the measured results of the respective measurement positions of the grill so that the respective measurement positions should be located at the predetermined reference positions relative to the reference plane. The positions of the respective spring pins of the four spring positioning means are agreed with positions of panel pins provided on four side portions of a panel of a cathode-ray tube. The four springs are welded to the four side portions of the aperture grill simultaneously.

According to the present invention, of the four spring pins, second and third spring pins opposed to each other in the first direction are moved so that first-direction positions of the second and third spring pins should be agreed with positions of second and third panel pins, which are opposed to each other in the first direction, of the panel pins. A first spring pin, which is one of the spring pins opposed to each other in the second direction perpendicular to the first direction, thereof is moved so that the first-direction position and second-direction position of the above-mentioned first spring pin should be agreed with a position of a first panel pin which is one of panel pins opposed to each other in the second direction. Further, a fourth spring pin thereof which is the other one of pins opposed to each other in the second direction is moved so that first-, second-, and third-direction positions, which are perpendicular to one another, of the above-mentioned fourth spring pin should be agreed with a position of a fourth panel pin which is the other one opposed to each other in the second direction,. Thus, the positions of the above-mentioned four springs are agreed with the positions of the above-mentioned four panel pins.

According to the present invention, the spring welding apparatus is an apparatus for welding the panel attachment springs to four side portions of the substantially rectangular aperture grill having the color selection grill, and includes the table, the aperture-grill supporting means for supporting the above-mentioned aperture grill on the table at three positions so that the posture of the aperture grill can be adjusted, the grill-position measuring means for measuring the positions of the plurality of measurement positions of the grill in a state that the aperture-grill supporting means supports the aperture grill, the aperture-grill posture adjusting means for driving the aperture-grill supporting means based on results obtained by measurement of the grill-position measuring means and for adjusting the posture of the aperture grill so that the plurality of measurement positions of the grill should be located at the respective predetermined positions, the aperture-grill positioning means for positioning on the table the aperture grill adjusted in posture by the aperture-grill posture adjusting means, first, second, third and fourth spring positioning means respectively disposed at positions corresponding to the four side portions of the aperture grill positioned by the aperture-grill positioning means, for bringing the above-mentioned springs in contact with the above-mentioned four side portions to position the springs, and the spring welding means for welding the springs positioned by the spring positioning means to the side portions of the aperture grill positioned by the aperture-grill positioning means. Of the four spring positioning means, the second and third spring positioning means opposed to each other in the first direction can be moved and adjusted in the first direction. The first spring positioning means thereof which is one of the means opposed to each other in the second direction perpendicular to the first direction can be moved and adjusted in the first and second directions. The fourth spring positioning means thereof which is the other one of the means opposed to each other in the second direction can be moved and adjusted in the first, second and third directions perpendicular to one another.

According to the present invention, after the posture of the aperture grill is adjusted so that the respective measurement positions of the grill relative to the reference plane should be located at the predetermined reference positions, the springs are welded to the side portions of the aperture grill. Therefore, even if the grill is twisted, the positions of the pin apertures of the springs relative to the respective measurement positions of the grill are precisely set to the design values. The panel attachment springs are precisely welded to the side-portion positions of the aperture grill. Accordingly, the interval between the grill surface and the inner surface of the panel portion is always set to the precise design value at any place in a state the aperture grill is attached to the panel. Therefore, it is possible to accurately radiate the electron beams passed through the grill on the corresponding fluorescent paint positions of the panel in the assembled CRT. It is also possible to reduce the ratio in production of the unsatisfactory aperture grills, which improves the yield.

It is possible to weld the four springs simultaneously. Therefore, an error in positioning the aperture grill and the springs is reduced, which can improve the quality of the cathode-ray tube. An equipment for the interval GH marriage and an equipment for the engagement marriage can be made integral, which can improve an efficiency in a space of the equipment.

BEST MODE CARRYING OUT THE INVENTION

An aperture grill to which the present invention is applied and an arrangement of a panel for supporting the aperture grille will initially be described.

Figure 1:
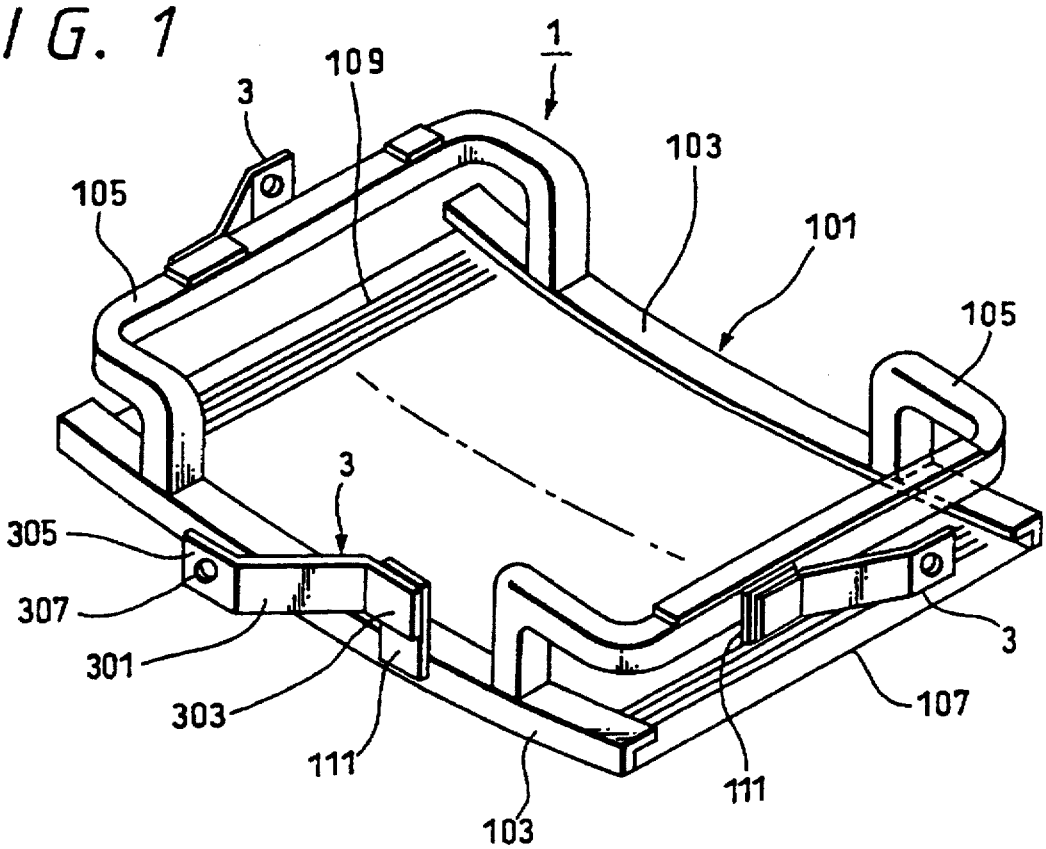
FIG. 1 is a perspective view of an example of an aperture grill to which the present invention is applied from its rear side.

FIG. 1 is a perspective view of an aperture grill seen from its rear side. An aperture grill 1 includes a substantially rectangular frame 101 formed of upper and lower lateral members 103 and left and right longitudinal members 105 for respectively jointing both rear-surface ends of the both lateral members 103, and a sheet-shaped grill 107 which is stretched between front surfaces of the above upper and lower lateral members 103 and through which a plurality of slits 109 extended in the upward and downward are formed at an interval in the left and right direction.

Each of the lateral member 103 is curved and formed so as to be projected forwards at its center portion as compared with its both end portions in the left and right direction. Spring holders 111 are welded to outer side surfaces of the lower lateral member 103 and the left and right longitudinal members 105. Panel attachment springs 3 are welded to outer surfaces of the respective spring holders 111.

Each of the springs 3 is formed of a middle portion 301, a base portion 303 and a head portion 305 both of which are formed projectingly from both ends of the middle portion 301, being formed so as to be rectangular when it is seen from its front side. The base portion 303 is bent toward an outer surface of the middle portion 301. The head portion 305 is bent toward an inner surface of the middle portion 301. A pin aperture 307 is formed through the head portion 305.

Figure 2:
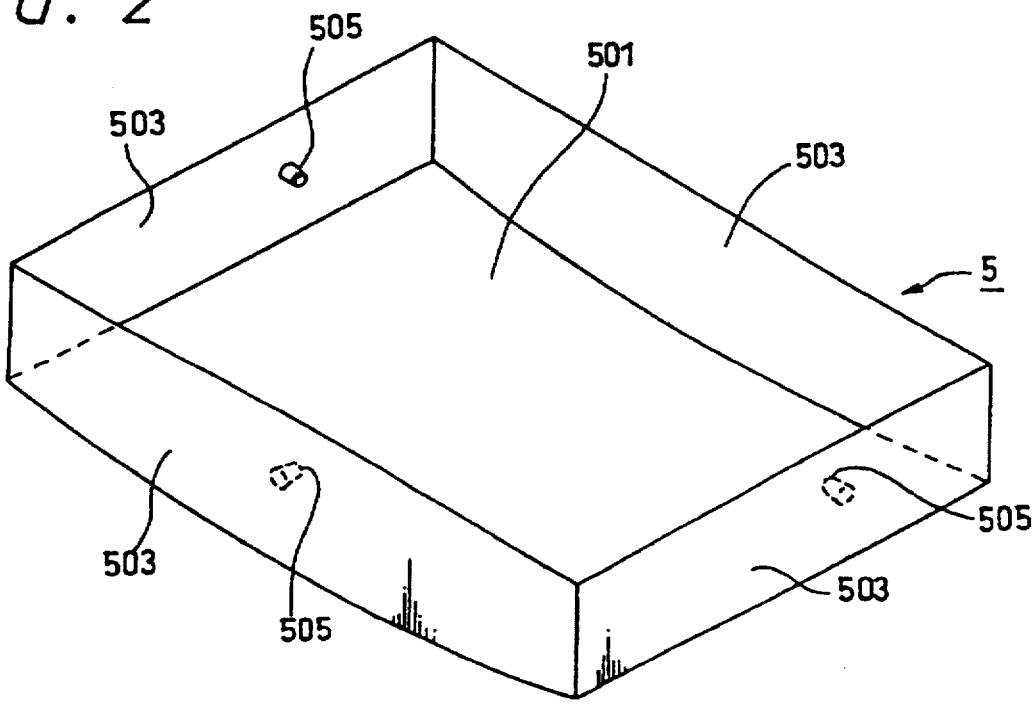
FIG. 2 is a perspective view of a panel to which the aperture grill shown in FIG. 1 is attached from its rear side.

FIG. 2 is a perspective view of a panel seen from its rear side. A panel 5 includes a substantially rectangular panel portion 501 which has a little larger size as compared with the grill 107 and is bent and formed so as to correspond to the frame 101, and four skirt portions of upper, lower, left and right skirt portions 503, formed projectingly from four sides of the panel portion 501. Pins (so-called panel pins) 505 capable of being engaged with the pin apertures 307 of the springs 3 are fitted to inner surfaces of the lower, left and right skirt portions 503.

Figure 3:
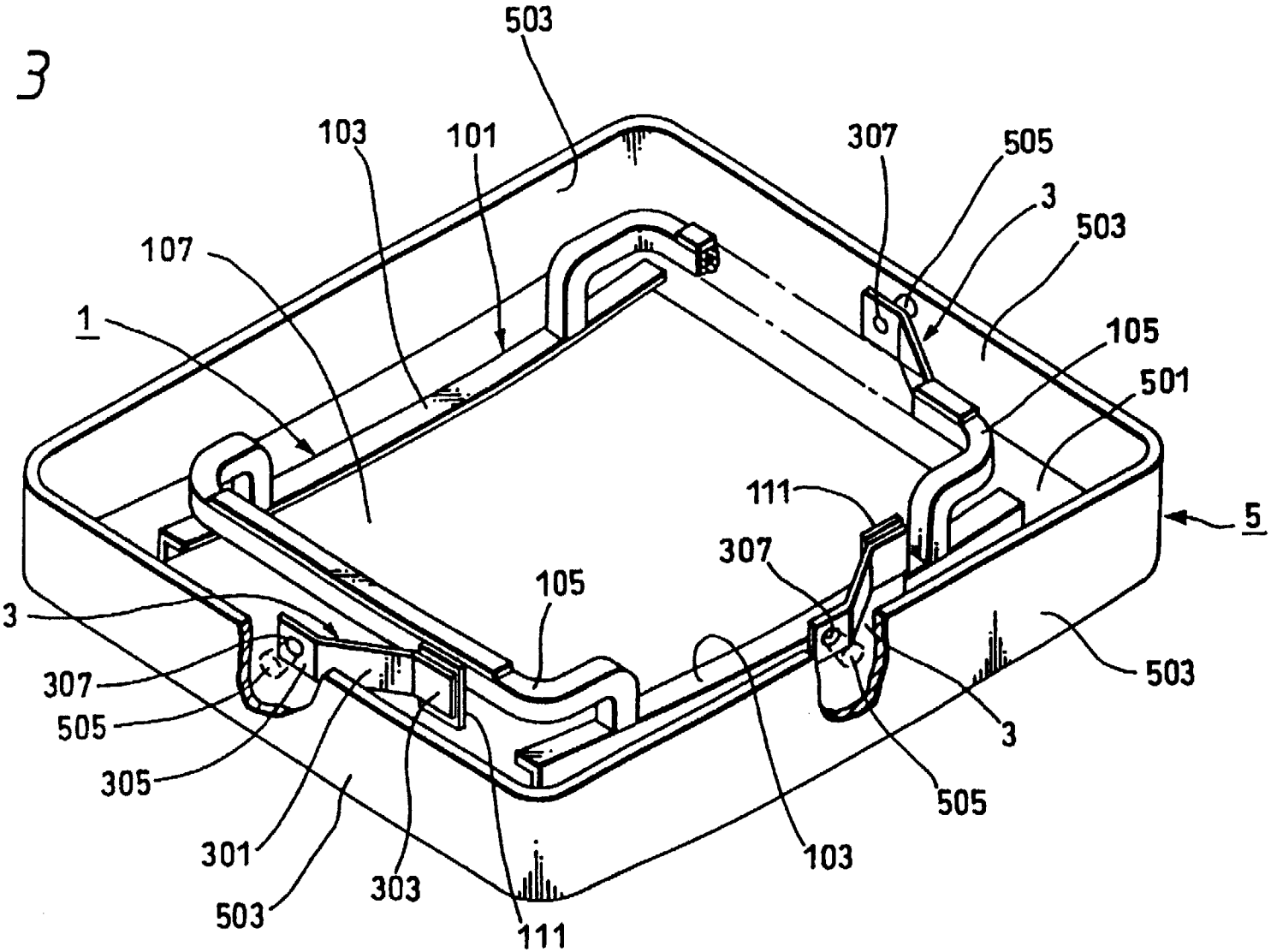
FIG. 3 is a perspective view showing a state in which the aperture grill is attached to the panel.

The aperture grill 1 is attached to the panel 5 by welding the base portions 303 of the springs 303 to the spring holders 111 to engage the pin apertures 307 of the springs 3 with the pins 505 of the panel 5 as shown in FIG. 3. Thus, the aperture grill 1 is supported at the inside of the panel 5.

A welding method according to the present invention together with a welding apparatus according to the present invention will be described.

Figure 4:
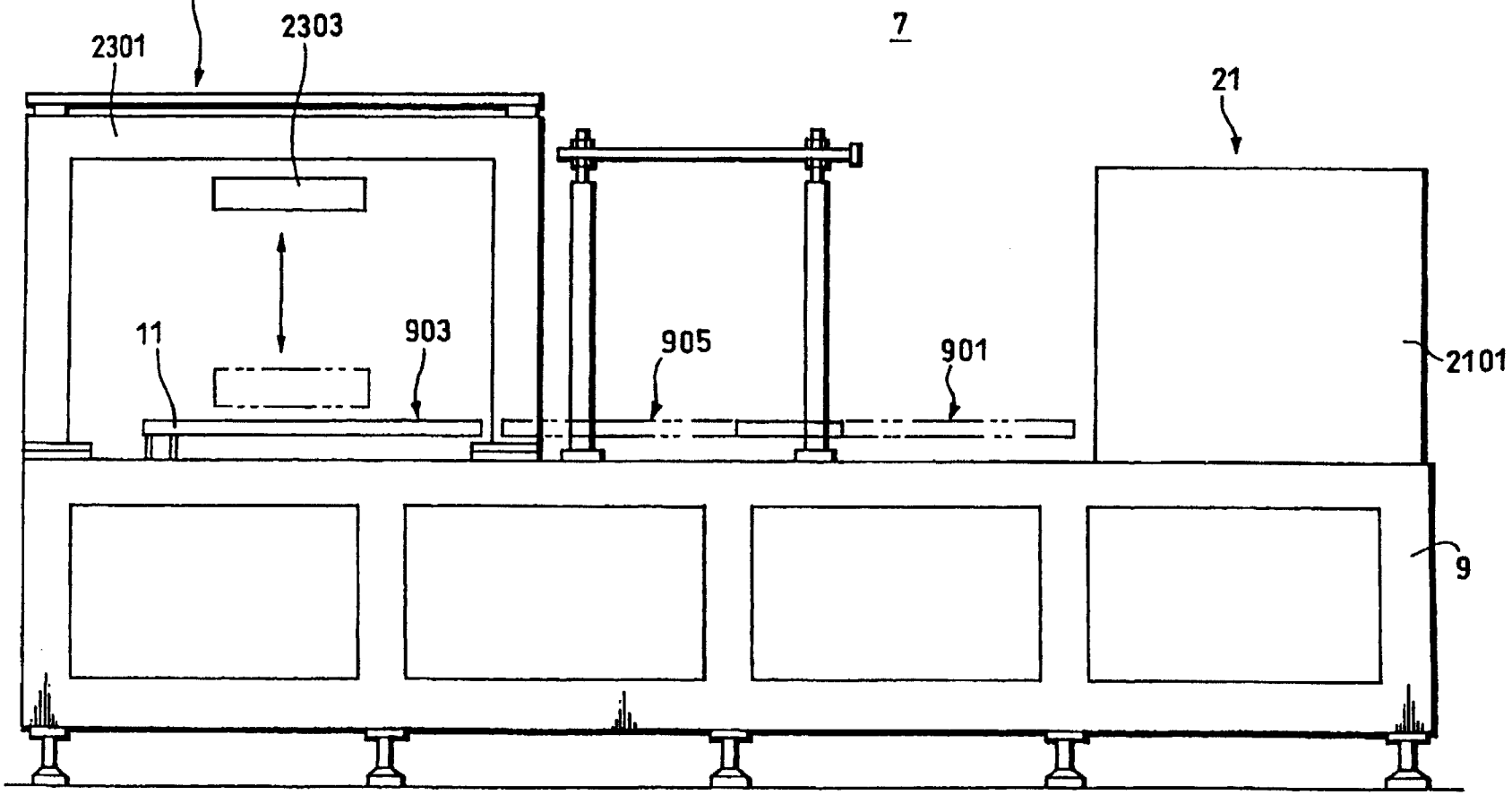
FIG. 4 is a front view of a welding apparatus according to an embodiment of the present invention.
Figure 5:
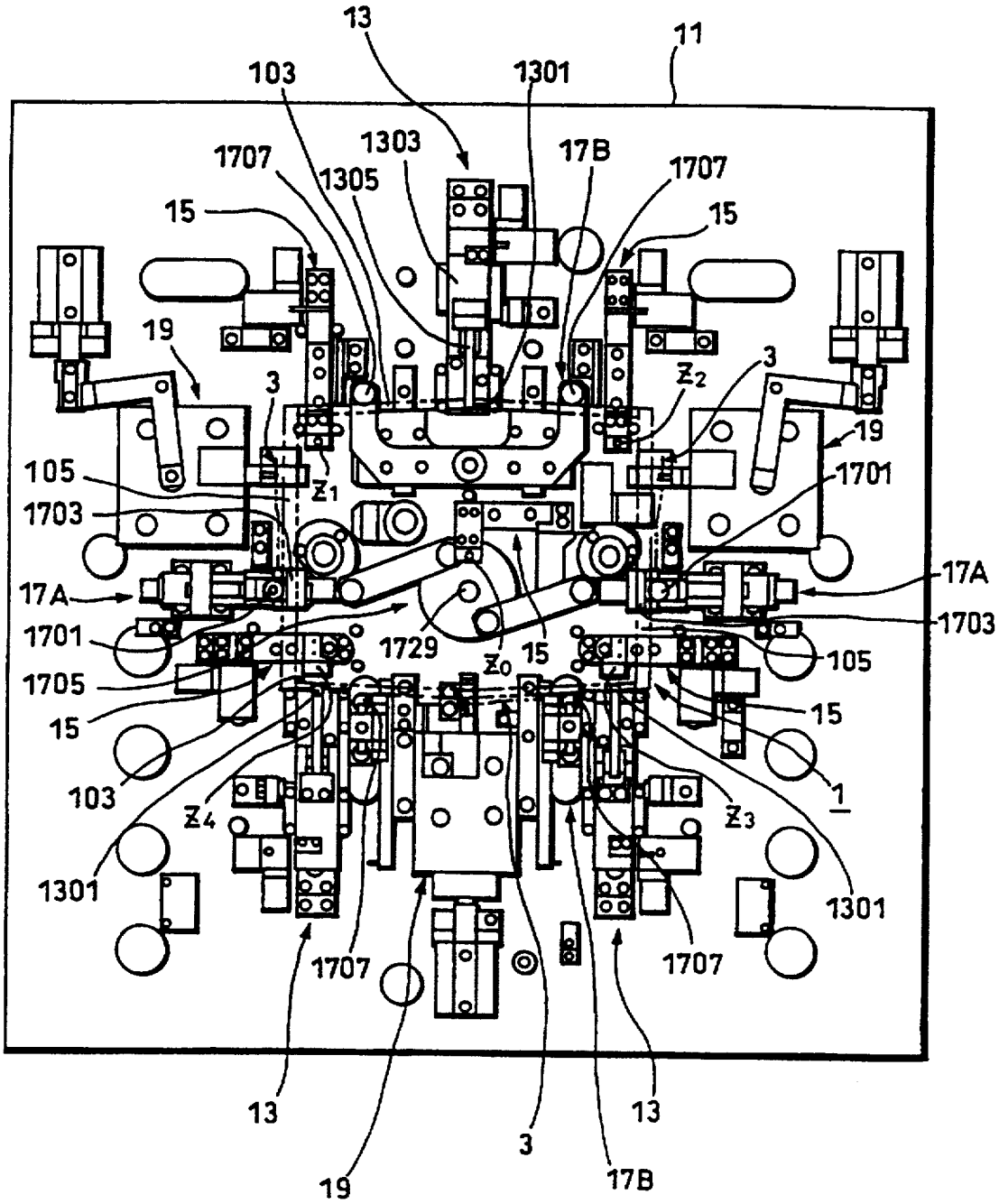
FIG. 5 is a plan view of a table of the welding apparatus according to the embodiment of the present invention.

FIG. 4 is a front view of a welding apparatus according to the embodiment. FIG. 5 is a plan view of a table in the welding apparatus.

A welding apparatus 7 includes a horizontally long base mount 9 having a rectangular shape when it is seen from its front side, a table 11 movably disposed on the base mount 9 for receiving the aperture grill 1 thereon, an aperture-grill supporting means 13 provided on the table 11, grill-position measuring means 15, left and right and upper and lower aperture-grill positioning means 17A, 17B, spring positioning means 19, a spring supplying means 21 provided on the base mount 9 for supplying the springs 3 to the spring positioning means 19, a spring welding means 23 for welding the springs 3 positioned by the spring positioning means 19 on the aperture grill 1, etc.

As shown in FIG. 4, the table 11 is moved by a table drive means, not shown, provided on the base mount 9 in the left and right direction among a spring supply position 901 located at a position to a right end of the base mount 9, a spring welding position 903 at the left end of the base mount 9, and an aperture-grill delivery position 905 located at the middle of both positions. At the aperture-grill delivery position 905, the aperture grill 1 is delivered by a conveying means (not shown) onto the table 11 with the front surface of the grill 107 being faced toward the table 11.

In the embodiment, an upper surface of the table 11 corresponds to a reference plane.

Three aperture-grill supporting means 13 are provided. As shown in FIG. 5, each of the aperture-grill supporting means 13 includes a supporting body 1301 supported by the table 11 so as to be capable of being lifted up and down. Each of the aperture-grill supporting means is arranged such that, in a state that the aperture grill 1 is delivered onto the table 11, the respective supporting bodies 1301 support the aperture grill at a substantial middle in the left and right direction of the front position of the upper lateral member 103 and two front positions, which are located at an interval in the left and right direction, of the lower lateral member 103.

Each of the supporting bodies 1301 is formed of a motor, a ball thread and so on and lifted up and down by a lifting and driving unit (not shown) provided between the table 11 and the supporting body 1301. The supporting bodies 1301 are lifted up and down by the lifting and driving unit under the control of a control means, not shown, (e.g., a microcomputer) based on a measured result of the grill-position measuring means 15. In the embodiment, the lifting and driving unit and the control means form an aperture-grill posture adjusting means.

In FIG. 5, reference numeral 1303 depicts a supporting plate combined with the supporting body 1301. Reference numeral 1305 depicts a press arm supported by the supporting plate 1303 so that the base portion 303 can be rocked. The press arm 1305 is rocked downward by a rocking and driving source, not shown, thereby a head portion of the press arm 1305 being brought in contact with each of the rear surfaces of the upper and lower lateral members 103. Thus, the lateral member 103 is pressed to the supporting body 1301.

As shown in FIG. 5, the five grill-position measuring means 15 are provided with corresponding to a measurement position $Z_0$ at a substantial center of the front of the grill 107 of the aperture grill 1 supported by the three supporting bodies 1301, and measurement positions $Z_1$ to $Z_4$ located to its four-corner sides.

Figure 6:
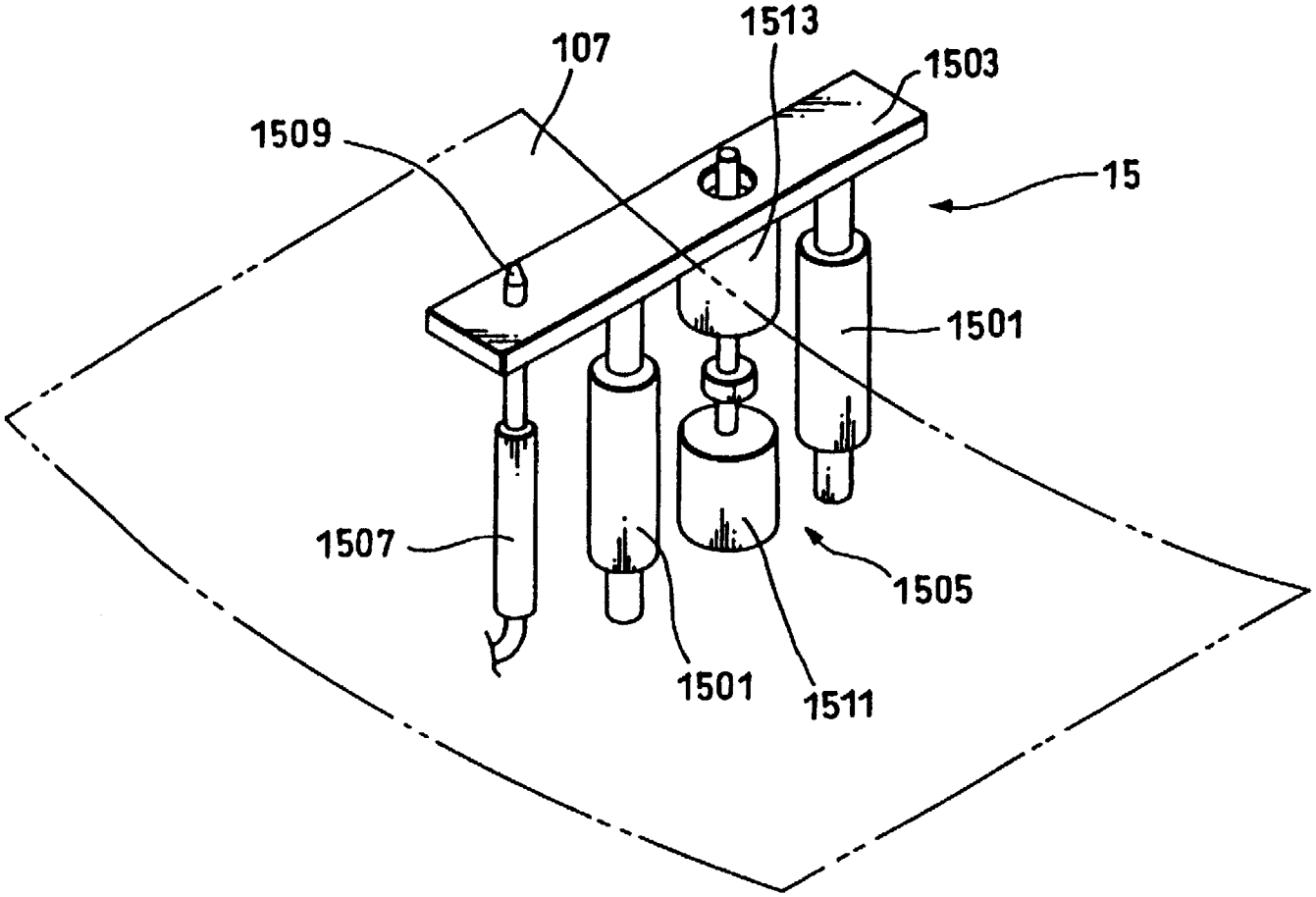
FIG. 6 is a perspective view showing a schematic arrangement of a grill-position measuring means of the welding apparatus according to the embodiment of the present invention.

As shown in FIG. 6, the grill-position measuring means 15 includes a supporting plate 1503 supported through two lifting guides 1501 on the table 11 side so as to be capable of being lifted up and down, a lifting and driving unit 1505 for lifting the supporting plate 1503 up and down, and a measuring instrument 1507 which is supported by the supporting plate 1503 and has a measuring point 1509 capable of being brought in contact with and away from the grill 107.

The lifting and driving unit 1505 includes a pulse motor 1511 supported by the table 11 and a ball thread 1513 fitted to the supporting plate 1503 and combined with an output shaft of the motor 1511. The measuring instrument 1507 is formed of a magnetic scale or a micrometer.

The grill-position measuring means 15 is arranged such that height of the supporting plate 1503 obtained when it is lifted up and down is adjusted by the lifting and driving unit 1505, the respective measuring points 1509 are brought in contact with the five measurement positions $Z_0$ to $Z_4$ of the grill 107 of the aperture grill 1 supported by the three supporting bodies 1301, thereby the measuring instrument 1507 measuring the positions of the measurement positions $Z_0$ to $Z_4$, and then the measured results are output to the above control means.

As shown in FIG. 5, the left and right aperture-grill positioning means 17A are respectively disposed on outer sides of the left and right longitudinal members 105, and the upper and lower aperture-grill positioning means 17B are respectively disposed on outer sides of the upper and lower lateral members 103.

Figure 7:
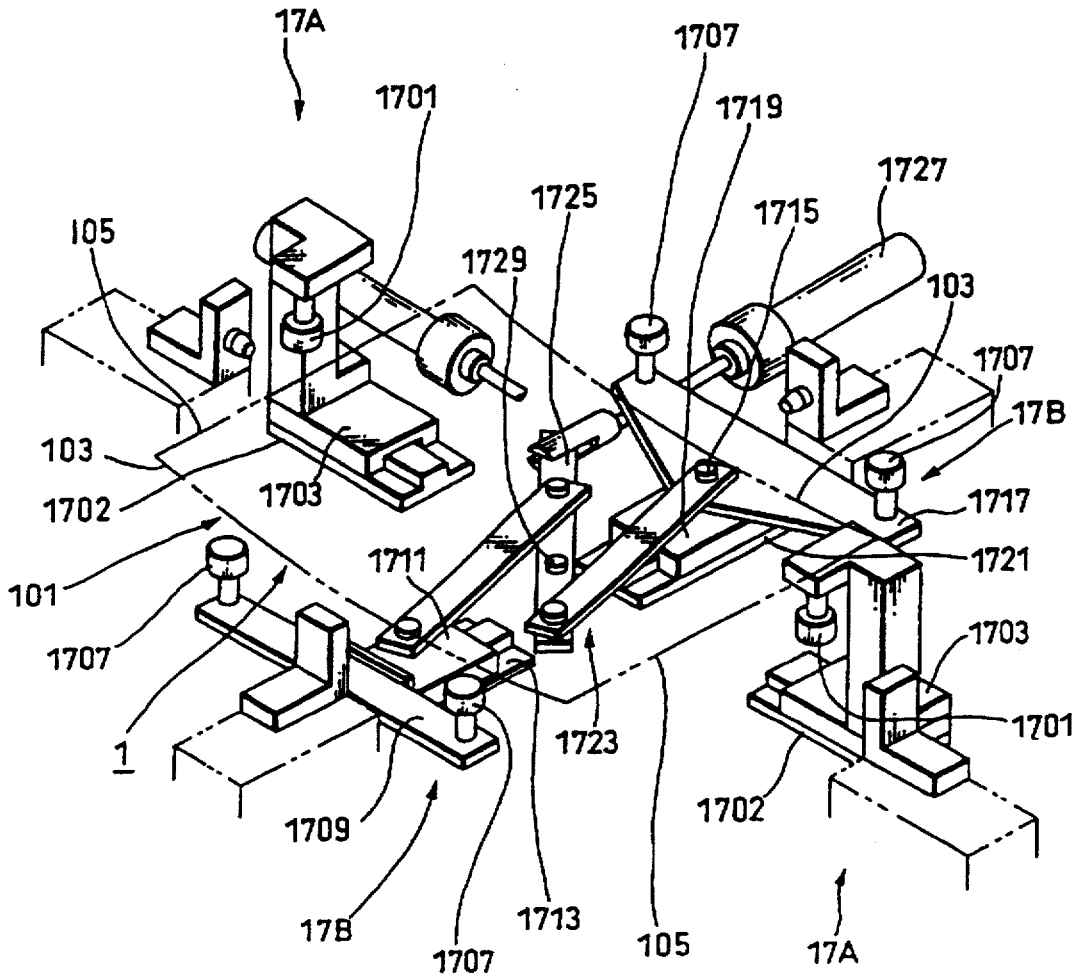
FIG. 7 is a perspective view of a parting mechanism for engaging and releasing upper and lower positioning rollers with and from upper and lower lateral members, of the welding apparatus according to the embodiment of the present invention.

As shown in FIG. 7, the respective left and right aperture-grill positioning means 17A include positioning rollers 1701 for being engaged with and released from substantially middle outer-surface positions in the upward and downward direction of the left and right longitudinal members 105, and sliders 1703 which rotatably support the rollers 1701 and are supported by the table 11 through guide rails 1702 so that they can be moved in the left and right direction.

As shown in FIG. 5, the left and right aperture-grill positioning means 17A are arranged such that a parting mechanism 1705 provided between the sliders 1703 of both of the aperture-grill positioning means 17A permits the left and right positioning rollers 1701 to be respectively engaged with and released from the left and right longitudinal members 105 of the aperture grill 1 supported by the three supporting bodies 1301 in synchronization with each other.

As shown in FIG. 7, the respective upper and lower aperture-grill positioning means 17B include two positioning rollers 1707 for being engaged with and released from two outside positions, which are located at an interval in the left and right direction, of the upper and lower members 103.

The two respective lower positioning rollers 1707 are rotatably supported at left and right ends of an arm 1709. The arm 1709 is supported at its substantially middle portion in the left and right direction by the table 11 through a slider 1711 and a guide rail 1713 so as to be movable in the upward and downward direction.

The two respective upper positioning rollers 1707 are provided at both of left and right ends of a rocking arm 1717 which can be rocked around a supporting shaft 1715. The supporting shaft 1715 is fitted to a slider 1719. The slider 1719 is supported by the table 11 through a guide rail 1721 so as to be movable in the upward and downward direction.

The upper and lower aperture-grill positioning means 17B are arranged such that a parting mechanism 1723 provided between the sliders 1711, 1719 of the both of the aperture-grill positioning means 17B permits the upper and lower positioning rollers 1707 to be engaged with and released from the upper and lower lateral members 103 of the aperture grill 1 supported by the three supporting bodies 1301 in synchronization with each other, and even if the frame 101 is twisted, the rocking of the rocking arm 1717 allows the respective upper and lower positioning rollers 1707 to be reliably engaged with the upper and lower lateral members 103, thereby the aperture grill 1 being able to be positioned.

The parting mechanism 1723 is driven by an expanding operation of an air cylinder 1727 combined with one end of a link 1725 of the parting mechanism 1723. The parting mechanism 1707 is driven by the expanding operation of the air cylinder 1727 through a rotation shaft 1729 fitted to a middle portion of the link 1725 in synchronization with the parting mechanism 1723.

The three spring positioning means 19 are provided. As shown in FIG. 5, the spring positioning means 19 are disposed on the outer sides of the lower lateral member 103 and the left and right longitudinal members 105 of the aperture grill 1, respectively.

Figure 8:
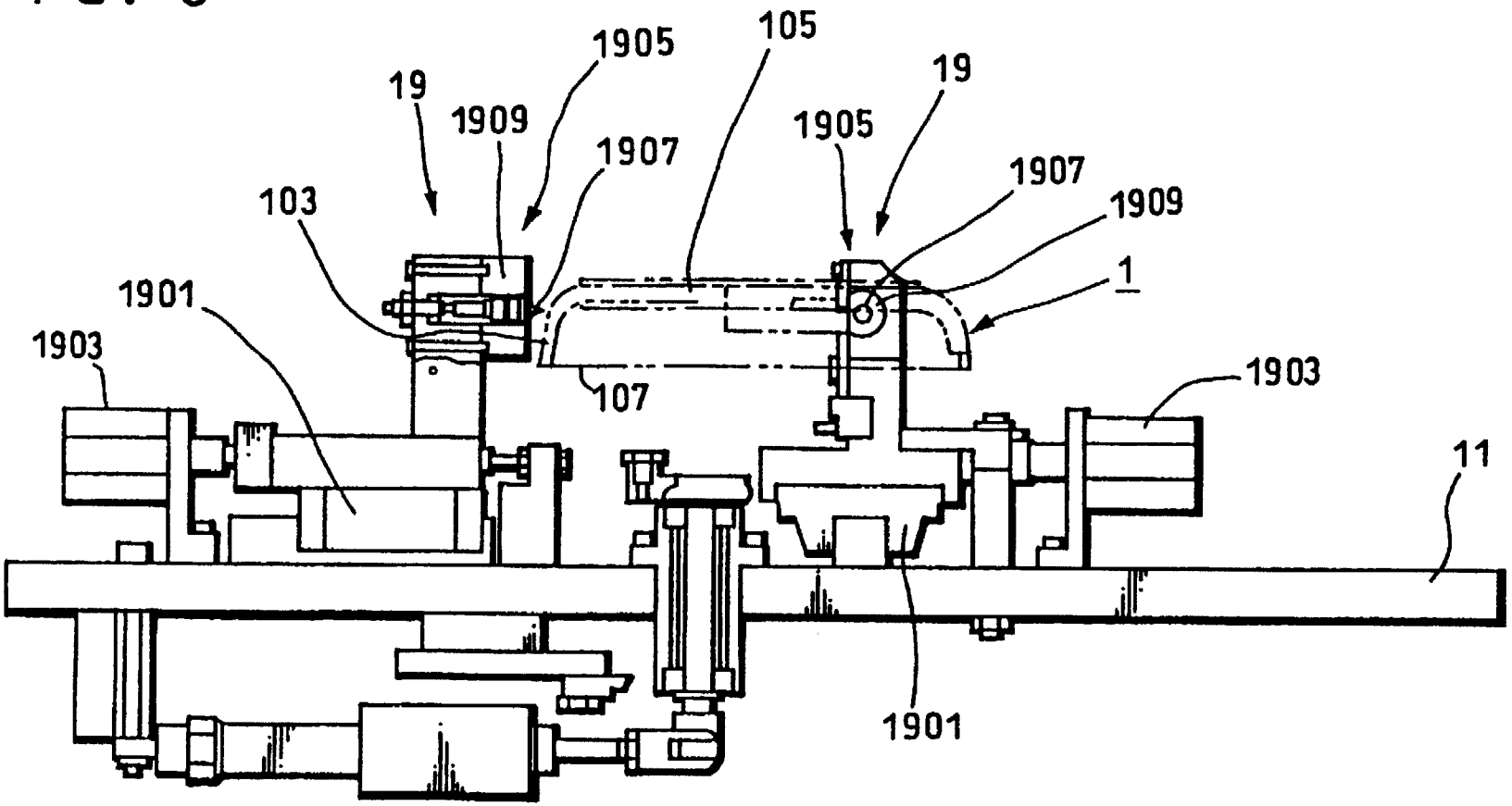
FIG. 8 is a diagram showing a schematic arrangement of a spring positioning means of the welding apparatus according to the embodiment of the present invention.

As shown in FIG. 8, each of the spring positioning means 19 includes a moving block 1901 supported by the table 11 so as to be movable on a plane in parallel to the upper surface of the table 11 in the direction in which the block is moved close to and away from the aperture grill 1, an air cylinder 1903 for moving the moving block 1901, and a holding member 1905 provided an the head end of the moving block 1901 opposed to the aperture grill 1 for holding the spring 3.

The holding member 1905 includes a pin (a so-called spring pin) 1907 which can be inserted into the pin aperture 307 of the spring 3, a ring-shaped magnet 1909 for being magnetically fitted to an outer surface of the head portion 305 of the spring 3 with the pin 1907 being inserted into the pin aperture 307, and two projections (not shown) which are engaged with both edges of the head portion 305 to thereby prevent the spring 3 from being rotated. The pins 1907 of the respective spring positioning means 19 are disposed above the table 11 at positions whose heights from the table are the same.

The spring positioning means 19 is arranged such that, in a state that the holding member 1905 holds the spring 3 and the moving block 1901 is brought close to the aperture grill 1 by the air cylinder 1903, the inner surface of the base portion 303 of the spring 3 is brought in contact with an outer surface of the spring holder 111 of the aperture grill 1, and as shown in FIG. 5, the spring 3 is deformed in the same state obtained when the aperture grill 1 is attached to the panel portion 501.

As shown in FIG. 4, the spring supplying means 21 includes a magazine 2101 disposed at the right end of the base mount 9 for housing a large number of springs 3, and a supply robot (not shown) for picking up the springs 3 from the magazine 2101 one by one and supplying them to the respective spring positioning means 19 at the spring supply position 901 of the tables 11.

The supply robot includes an arm movably provided between the magazine 2101 and each of the spring positioning means 19, a chuck provided at the tip end of the arm so as to be capable of being opened and closed, and a drive source for moving the arm and for opening and closing the chuck. The supply robot is arranged such that the chuck grips the middle portion 301 of the spring 3 located at a spring pickup slot (not shown) of the magazine 2101 and the spring 3 is delivered to the holding member 1905 brought in a state that the moving block 1901 is moved in the direction in which the moving block is moved away from the aperture grill 1.

As shown in FIG. 4, the spring welding means 23 includes a supporting frame 2301 provided at the left end of the base mount 9 so as to stand, a welding machine 2303 supported by the supporting frame 2301 so as to be lifted up and down, and a lifting and driving mechanism (not shown) for lifting the welding machine 2303 up and down. The welding machine 2303 includes three welding units (not shown) for the lower lateral member 103, the left longitudinal member 105, and the right longitudinal member 105.

Each of the welding units includes two electrode portions disposed so as to be moved close to and away from each other with being opposed to each other. In a state that the welding machine 2303 is lifted down by the lifting and driving mechanism, the respective electrode portions are opposed to the inner surface of the spring holder 111 and the outer surface of the base portion 303 of the spring 3. The respective electrode portions are brought close to each other to be brought in contact with the spring holder 111 and the spring 3 and then energized, thereby the spring holder 111 and the spring 3 being welded by spot welding.

It will be described to weld the spring 3 to the spring holder 111 by the above welding apparatus.

The spring supplying means 21 supplies the spring 3 to each of the spring positioning means 19 at first.

Then, the table drive means moves the table 11 to the aperture-grill delivery position 905, where the lifting and driving units of the aperture-grill supporting means 13 respectively locate the head ends of the three supporting bodies 1301 at the reference positions whose heights from the table 11 are the same. In this state, the above conveying means mounts the aperture grill 1 on the three supporting bodies 1301.

The lifting and driving units 1505 of the grill-position measuring means 15 respectively lift the supporting plates 1503 to bring the respective measuring points 1509 of the five measuring instruments 1507 in contact with the five measurement positions $Z_0$ to $Z_4$. The measuring instruments 1507 measure the positions of the measurement positions $Z_0$ to $Z_4$ based on the heights of the supporting plates 1503 at this time, respectively. In this embodiment, the respective measuring instruments 1507 measure the heights from the table 11 to the measurement positions $Z_0$ to $Z_4$, respectively.

The above control means compares the respective heights of the measurement positions $Z_0$ to $Z_4$ with predetermined reference values indicative of ideal heights of the measurement positions $Z_0$ to $Z_4$. The control means also determines whether or not the heights of the four measurement positions $Z_1$ to $Z_4$ to the four-corner sides of the grill 107 are equal.

The above predetermined reference values are determined based on height values obtained when, in a state that the head ends of the three supporting bodies 1301 are located at the reference positions whose heights from the table 11 are the equal and a master of the aperture grill 1 precisely manufactured in accordance with the design values is mounted on the three supporting bodies 1301, the measuring instruments 1507 measure the heights from the table 11 of the respective measurement positions $Z_0$ to $Z_4$. The positions of the respective measurement positions $Z_0$ to $Z_4$ on the master at this time correspond to the reference positions.

When the heights of the measurement positions $Z_0$ to $Z_4$ are deviated from the reference values or when the heights of the four measurement positions $Z_1$ to $Z_4$ on the four-corner side of the grill 107 are uneven, the measuring points 1509 are moved away from the respective measurement positions $Z_0$ to $Z_4$. In order to correct differences between the heights of the respective measurement positions $Z_0$ to $Z_4$ and the reference values and unevenness of the heights of the four measurement positions $Z_1$ to $Z_4$ on the side of the four corners of the grill 107, the lifting and driving unit is operated under the control of the above control means to lift the respective supporting bodies 1301 up and down, thereby the posture of the aperture grill 1 being adjusted.

If the differences between the heights of the respective measurement positions $Z_0$ to $Z_4$ and the reference values and unevenness of the heights of the four measurement positions $Z_1$ to $Z_4$ on the side of the four corners of the grill 107 have been corrected by adjusting the posture of the aperture grill 1, the measuring points 1509 are moved away from the respective measurement positions $Z_0$ to $Z_4$, and the positioning rollers 1707, 1701 are engaged with the upper and lower lateral members 103 and the left and right longitudinal members 105, respectively, thereby the aperture grill 1 being positioned. Thereafter, the table drive means moves the table 11 to the spring supply position 901.

The moving blocks 1901 of the spring positioning means 19 are moved in the directions in which they move close to the aperture grill 1, thereby the base portions 303 of the springs 3 being brought in contact with the spring holders 111.

The table drive means moves the table 11 to the spring welding position 903, where the welding machine 2303 of the spring welding means 23 is lifted down and the three welding units weld the base portions 303 of the springs 3 to the respective spring holders 111. Thereafter, the measuring instruments 1507 measure the heights of the respective measurement positions $Z_0$ to $Z_4$ again.

The welding machine 2303 is lifted up next. The table drive means moves the table 11 to the aperture-grill delivery position 905. The moving blocks 1901 of the spring positioning means 19 are moved in the directions in which they are moved away from the aperture grill 1, thereby the pins 1907 being pulled out of the pin apertures 307 of the springs 3. The positioning rollers 1707, 1701 are respectively moved away from the upper and lower lateral members 103 and the left and right longitudinal members 105, thereby the operation for positioning the aperture grill 1 being released. The above conveying means conveys the aperture grill 1 from the table 11.

According to this embodiment, the three supporting bodies 1301 located at the reference positions whose heights from the table 11 are the same respectively support the upper lateral member 103 of the aperture grill 1 delivered to the table 11 by the conveying means at one position and the lower lateral member 103 thereof at two positions. In this state, the positions of the five measurement positions $Z_0$ to $Z_4$ located at the substantial center and on the sides of the four corners of the grill 107 are measured. In accordance with the measured results, the respective supporting bodies 1301 are lifted up or down. The posture of the aperture grill 1 is adjusted so that the heights of the respective measurement positions $Z_0$ to $Z_4$ should be agreed with the reference values and the four measurement positions $Z_1$ to $Z_4$ should be equal.

Figure 9:
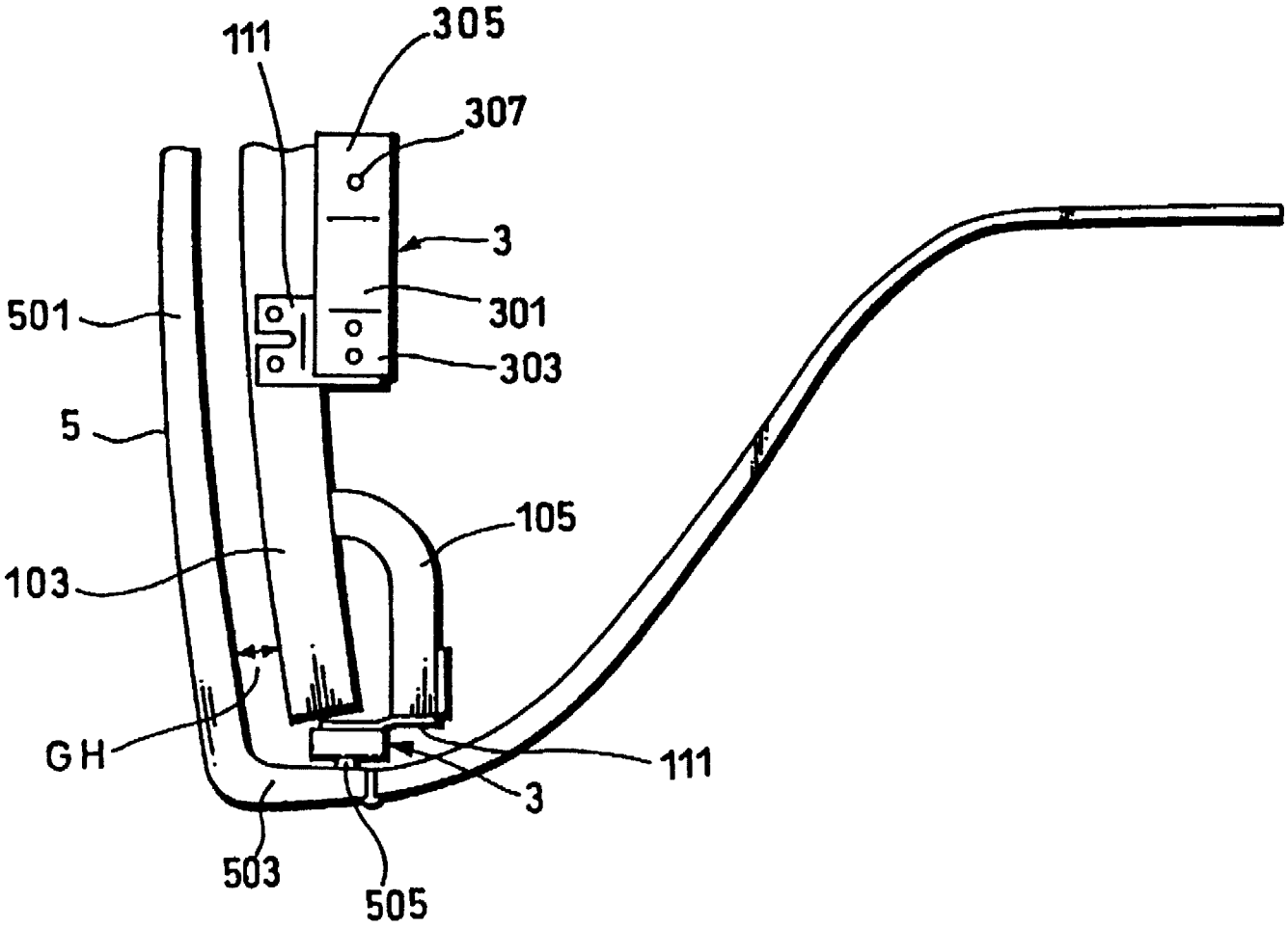
FIG. 9 is an explanatory diagram showing a state that an aperture grill is attached to a panel.

Therefore, even if the frame 101 and the grill 107 are twisted because of the strain of the respective lateral and longitudinal members 103, 105 and so on, the springs 3 are reliably supplied and welded to the positions of the lateral and longitudinal members 103, 105 where the positions of the respective pin apertures 307 relative to the measurement positions $Z_0$ to $Z_4$ are set to the precise design values. Accordingly, it is always possible to set the interval GH (Grill Height) between the surface of the grill 107 and the inner surface of the panel portion 501 to the precise design values at any place, as shown in FIG. 9, in the state that the aperture grill 1 is attached to the panel 5. The electron beams passed through the grill can be radiated on the corresponding fluorescent paint positions of the panel portion, which can reliably prevent the defects of the assembled CRT such as the erroneous landing of the beam or the like. It is possible to reduce a ratio in production of the unsatisfactory aperture grill 1 in which the pin aperture 307 is positionally displaced. This reduction can improve the yield.

According to the embodiment, the table 11 is movably provided on the base mount 9. The operation of the conveying means for delivering and conveying the aperture grill 1 to and from the table 11, the operation of the spring supplying means 21 for supplying the springs 3 to the respective spring positioning means 21 on the table 11, and the operation of the spring welding means 23 for welding the springs 3 to the aperture grill 1 are carried out at the positions which are different from one another on the base mount 9. Therefore, the conveying means, the spring supplying means 21 and the spring welding means 23 can carry out their works without interfering one another.

Further, according to the embodiment, there are provided on the table 11 all of the aperture-grill supporting means 13, the aperture-grill positioning means 17A, 17B, and the spring positioning means 19 which are used upon two operations or more of the operation of measuring the positions of the measurement positions $Z_0$ to $Z_4$ of the grill 107, the operation of supplying the springs 3 to the respective spring positioning means 19, and the operation of welding the springs 3 to the spring holders 111. Therefore, it is not necessary to independently provide the above-mentioned means 13, 17A, 17B, 19 at the spring supply position 901, the spring welding position 903 and the aperture-grill delivery position 905 on the base mount 9, respectively. It is possible to form the respective means 13, 17, 19 integrally, and hence it is possible to simplify the arrangement of the welding apparatus 7.

Since all of the aperture-grill supporting means 13, the aperture-grill positioning means 17A, 17B, and the spring positioning means 19 are provided on the table 11, when the table 11 is moved to the positions 901, 903, 905 while the respective means 13, 17A, 17B, 19 are being operated, it is possible to carry out the operation of measuring the positions of the measurement positions $Z_0$ to $Z_4$ of the grill 107 and the operation of supplying the springs 3 to the respective spring positioning means 19 with the aperture grill 1 being kept in a certain posture. It is also possible to carry out the operation of welding the springs 3 to the spring holders 111 with the aperture grill 1 and the springs 3 being kept in their certain postures.

Accordingly, it is possible to prevent the positions of the aperture grill 1 or the springs 3 during the respective operations from being changed and hence it is possible to precisely weld the springs 3 to predetermined positions of the spring holders 111.

While in this embodiment the three supporting bodies 1301 respectively support the upper lateral member 103 of the aperture grill 1 at one position and the lower lateral member 103 thereof at two positions, the positions of the aperture grill 1 at which the supporting bodies 1301 support the aperture grill are not limited to those described in the embodiment, e.g., the three supporting bodies 1301 may respectively support the upper lateral member 103 at two positions and the lower lateral member 103 at one position, or the three supporting bodies 1301 may respectively support one member 105 of the left longitudinal member 105 and the right longitudinal member 105 at one position and the other member 105 at two positions.

While in the embodiment the aperture-grill supporting means 13 consists of the three supporting bodies 1301, the arrangement of the aperture-grill supporting means 13 is not limited to the arrangement described in the embodiment and may be selected optionally; the aperture-grill supporting means 13 may consist of a plurality of articulated arms provided on the table 11 and chucks provided at head ends of the respective articulated arms for gripping proper positions of the left and right longitudinal members 105.

While in the embodiment the aperture grill 1 is supported with the front surface of the grill 107 being faced to the table 11 side, the aperture grill 1 may be supported with the rear surface of the grill 107 being faced to the table 11 side.

While in the embodiment the table 11 is moved on the base mount 9 to the spring supply position 901, the spring welding position 903 and the aperture-grill delivery position 905, the operation of delivering and conveying the aperture grill 1 to and from the table 11, the operation of supplying the springs 3 to the respective spring positioning means 19, and the operation of welding the springs 3 to the aperture grill 1 may be carried out optionally at the same position or different positions on the base mount 9, for example, with such an arrangement that the table 11 is fixed and the spring supplying means 21 and the spring welding means 23 are provided movably or the like.

Further, while in the embodiment the five grill-position measuring means 15 measure the positions of the five measurement positions $Z_0$ to $Z_4$ at the substantial center position of the front surface of the grill 107 and the positions to the four corners thereof, the positions of the measurement positions of the grill 107 and the number of the above measurement positions and the grill-position measuring means 15 are not limited to those described in the embodiment and may be selected optionally.

While in the embodiment the aperture grill 1 is conveyed onto the table 11 after the springs 3 are supplied to the spring positioning means 19, the springs 3 may be supplied to the spring positioning means 19 after the aperture grill 1 is conveyed onto the table 11, for example, and it may optionally be selected which of the aperture grill 1 and the springs 3 are first conveyed onto the table 11.

Further, while in the embodiment there is described the case where the number of the pins 505 of the panel 5 and the number of the springs 3 welded to the aperture grill 1 are respectively three, the present invention can be applied to the case where the number of the pins 505 of the panel 5 and the number of the springs 3 welded to the aperture grill 1 are respectively four.

Subsequently, there will be described an embodiment in the case where the number of the pins and the number of the springs welded to the aperture grill are respectively four. Specifically, a method of and an apparatus for welding four springs simultaneously will be described.

Figure 10:
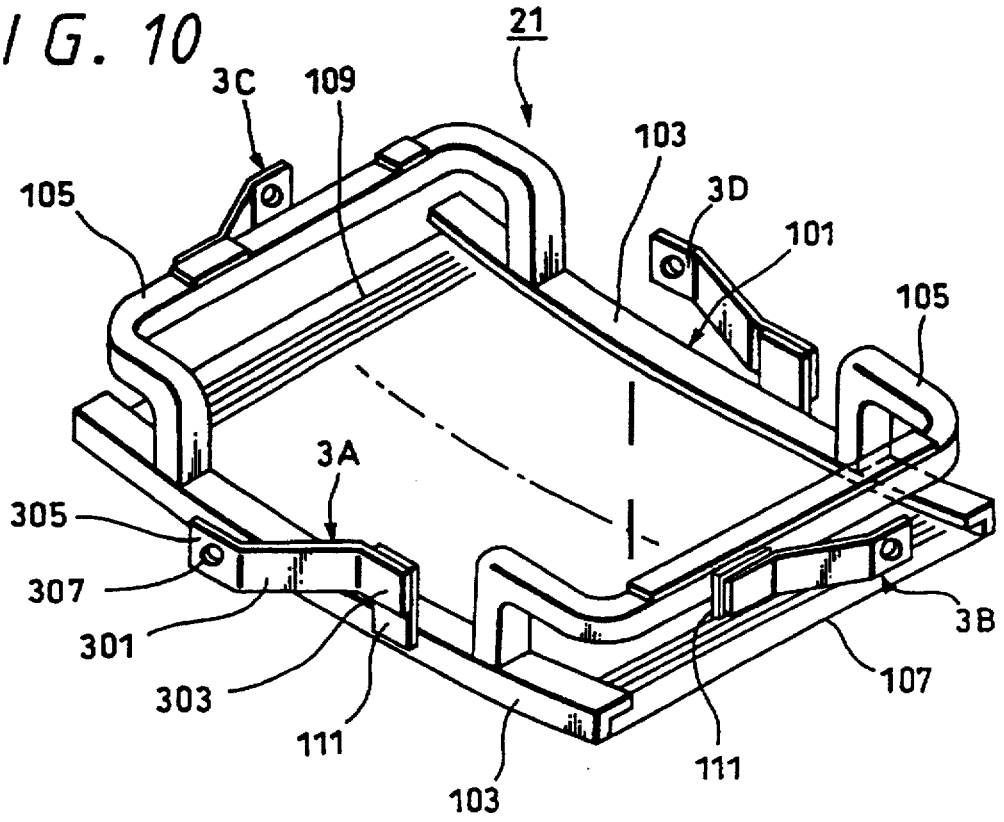
FIG. 10 is a perspective view of another example of the aperture grill to which the present invention is applied from its rear side.
Figure 11:
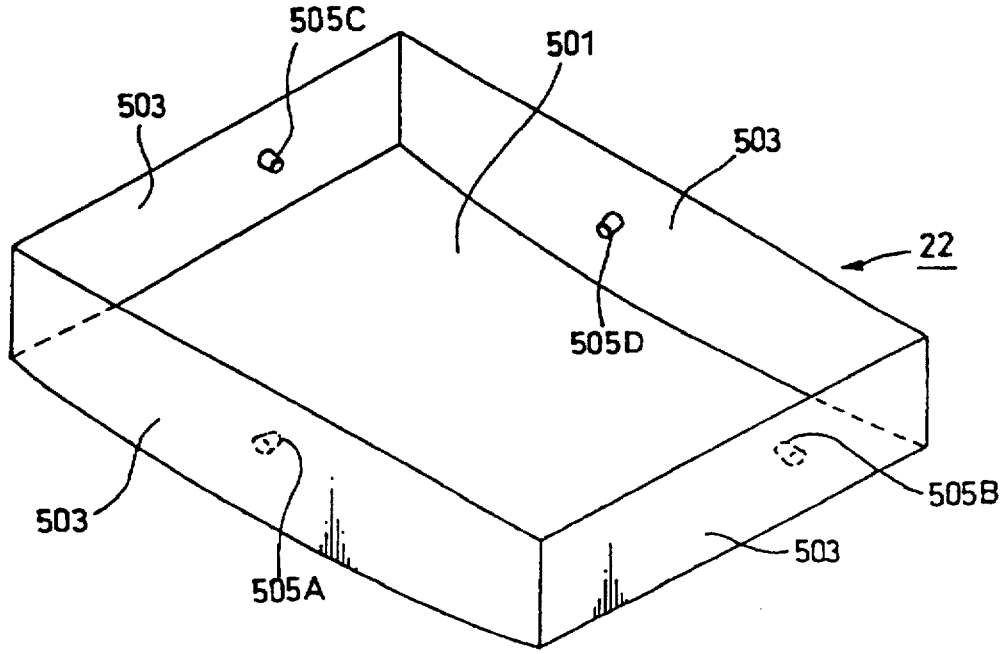
FIG. 11 is a perspective view of a panel to which the aperture grill shown in FIG. 10 is attached from its rear side.

FIGS. 10 and 11 show an aperture grill 21 to which the embodiment is applied, and a panel 22 for supporting the aperture grill 21. In FIGS. 10 and 11, parts corresponding to those shown in FIGS. 1 and 2 are marked with the same reference numerals and hence need not be described.

Figure 12:
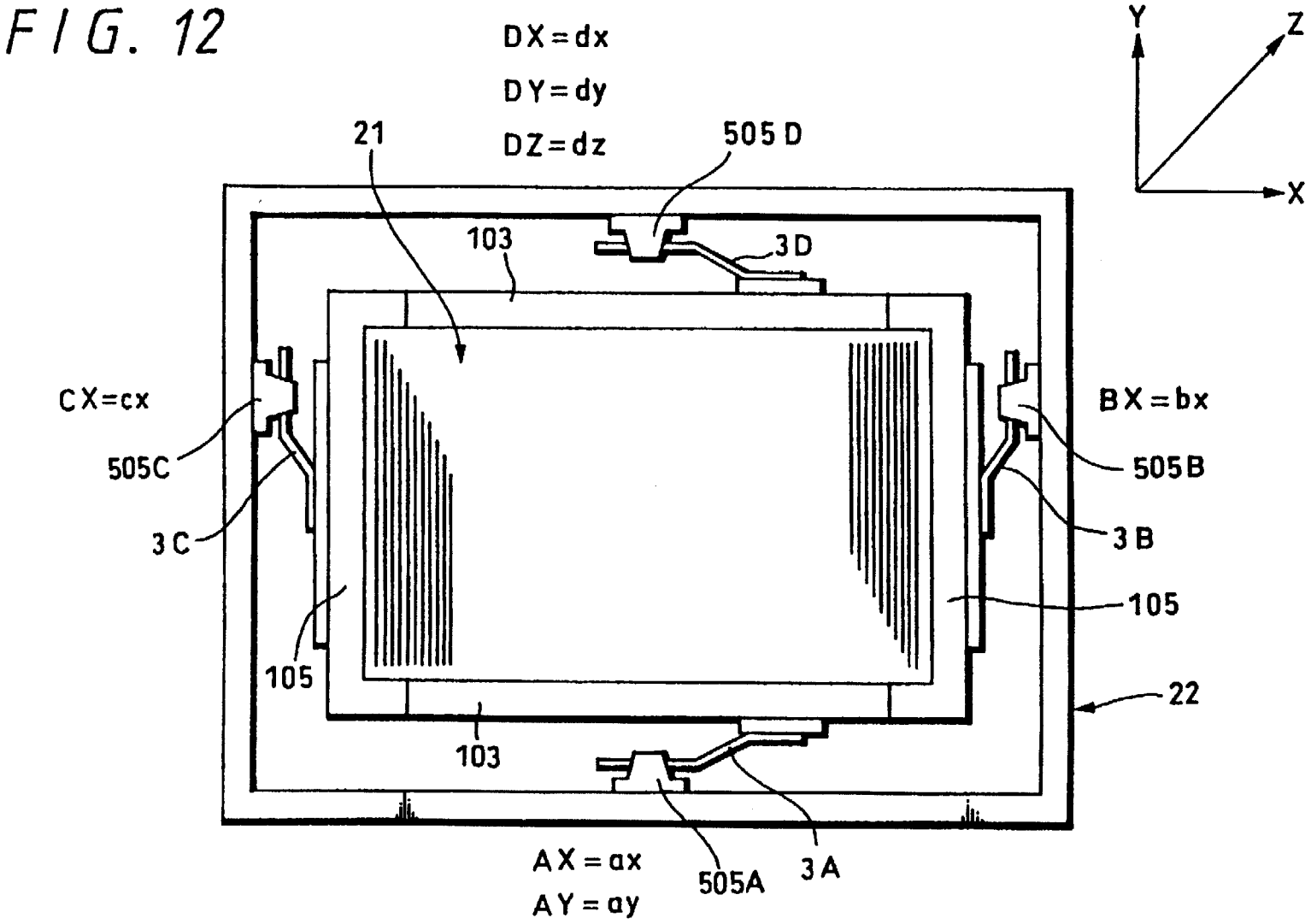
FIG. 12 is a rear view showing a state that the aperture grill is attached to the panel.
Figure 13:
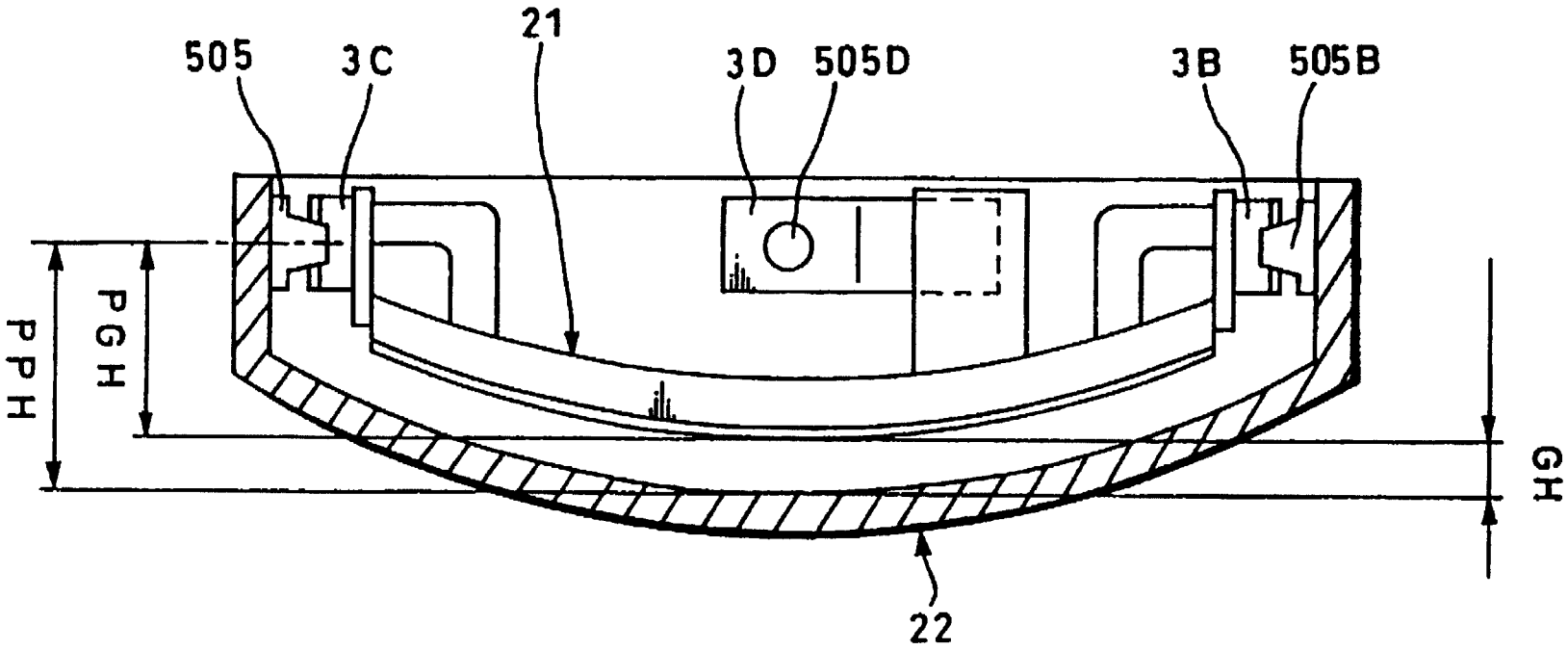
FIG. 13 is a cross-sectional view showing a state that the aperture grill is attached to the panel.

The aperture grill 21 is arranged such that a sheet-shaped grill 107 through which a plurality of slits 10 are formed is stretched at a substantially rectangular frame 101 formed of upper and lower lateral members 103 and left and right longitudinal members 105 similarly to the above-mentioned aperture grill, and that four panel attachment springs 3 [3A, 3B, 3C, 3D] are respectively welded through spring holders 111 to four positions on outer surfaces of the upper and lower lateral members 103 and the left and right longitudinal members 105. A panel 22 includes a substantially rectangular panel portion 501 and four skirt portions 503 projectingly formed from four sides of the panel portion 501 similarly to the above-mentioned panel, being arranged such that pins (so-called panel pins) 505 [505A, 505B, 505C, 505D] which can be engaged with pin apertures 307 of the above corresponding springs 3 [3A, 3B, 3C, 3D] are fitted to inner surfaces of the four skirt portions 503. The above aperture grill 21 is attached to the panel 22 by welding base portions 303 of the respective springs 3A to 3D to the spring holders 111 to engage the pin apertures 305 of the respective springs 3A to 3D with the corresponding pins 505A to 505D of the panel 22 as shown in FIGS. 12 and 13. Thus, the aperture grill 21 is supported at the inside of the panel 22.

Figure 14:
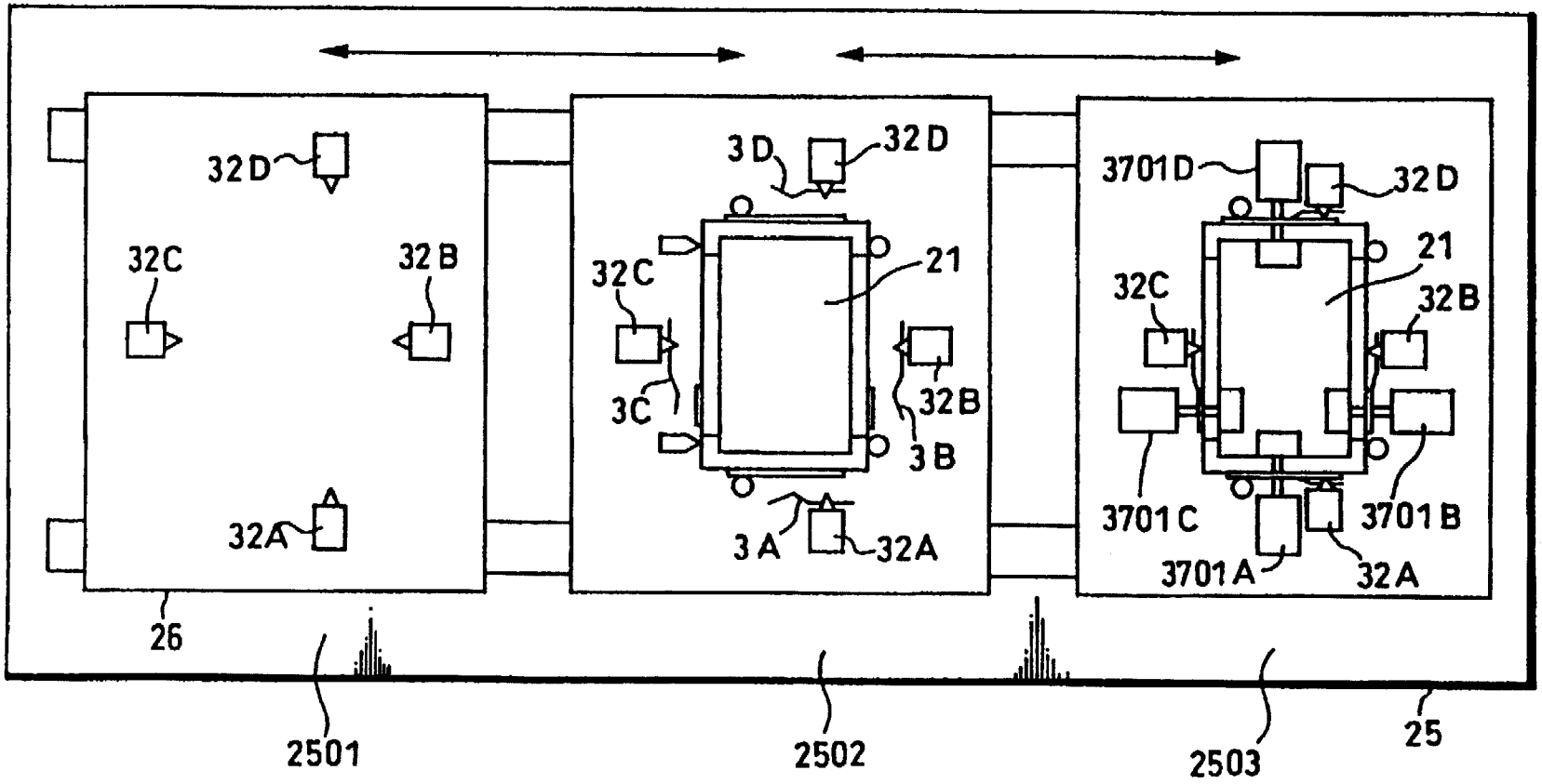
FIG. 14 is a schematic, plan view of a welding apparatus according to another embodiment of the present invention.
Figure 15:
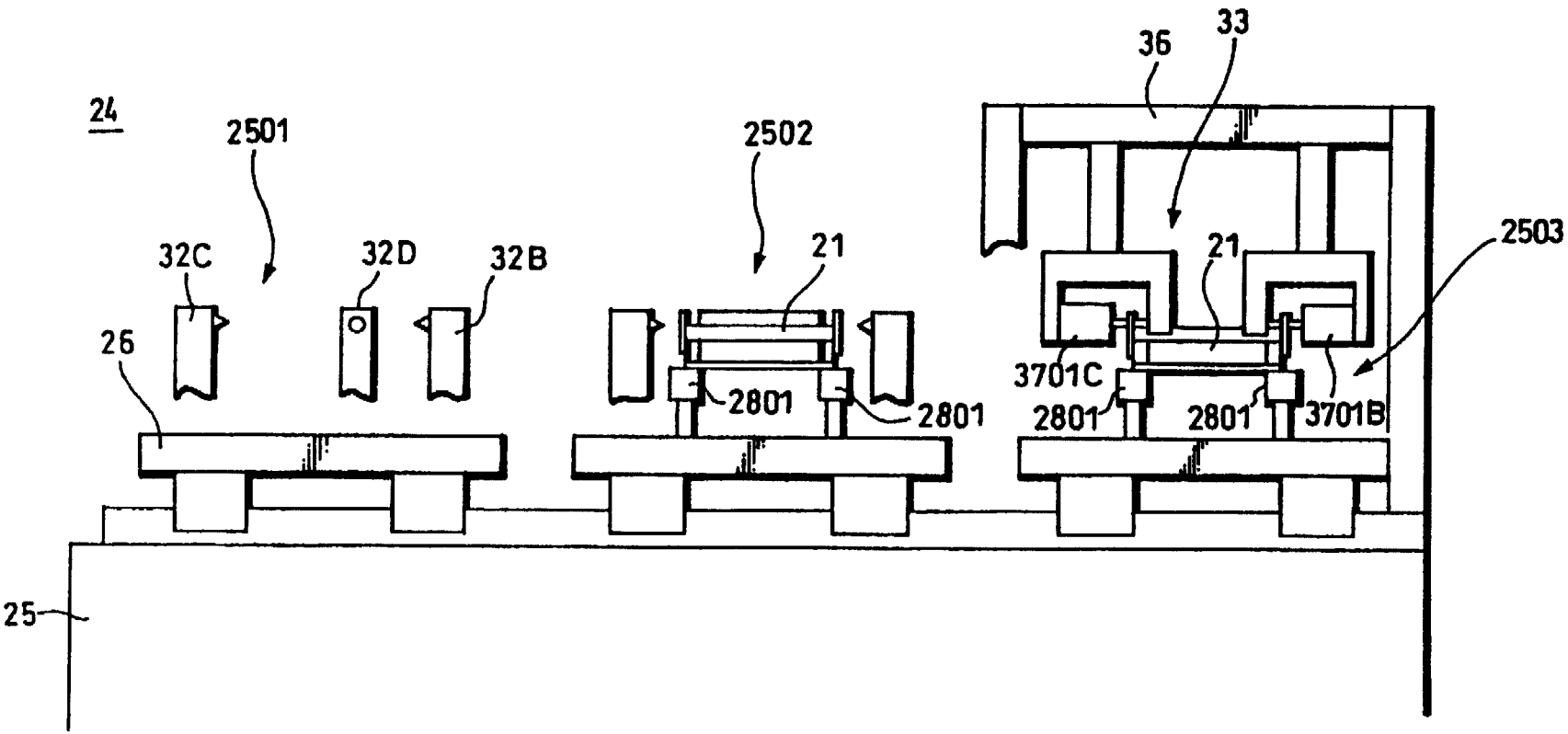
FIG. 15 is a schematic, front view of the welding apparatus according to another embodiment of the present invention.
Figure 16:
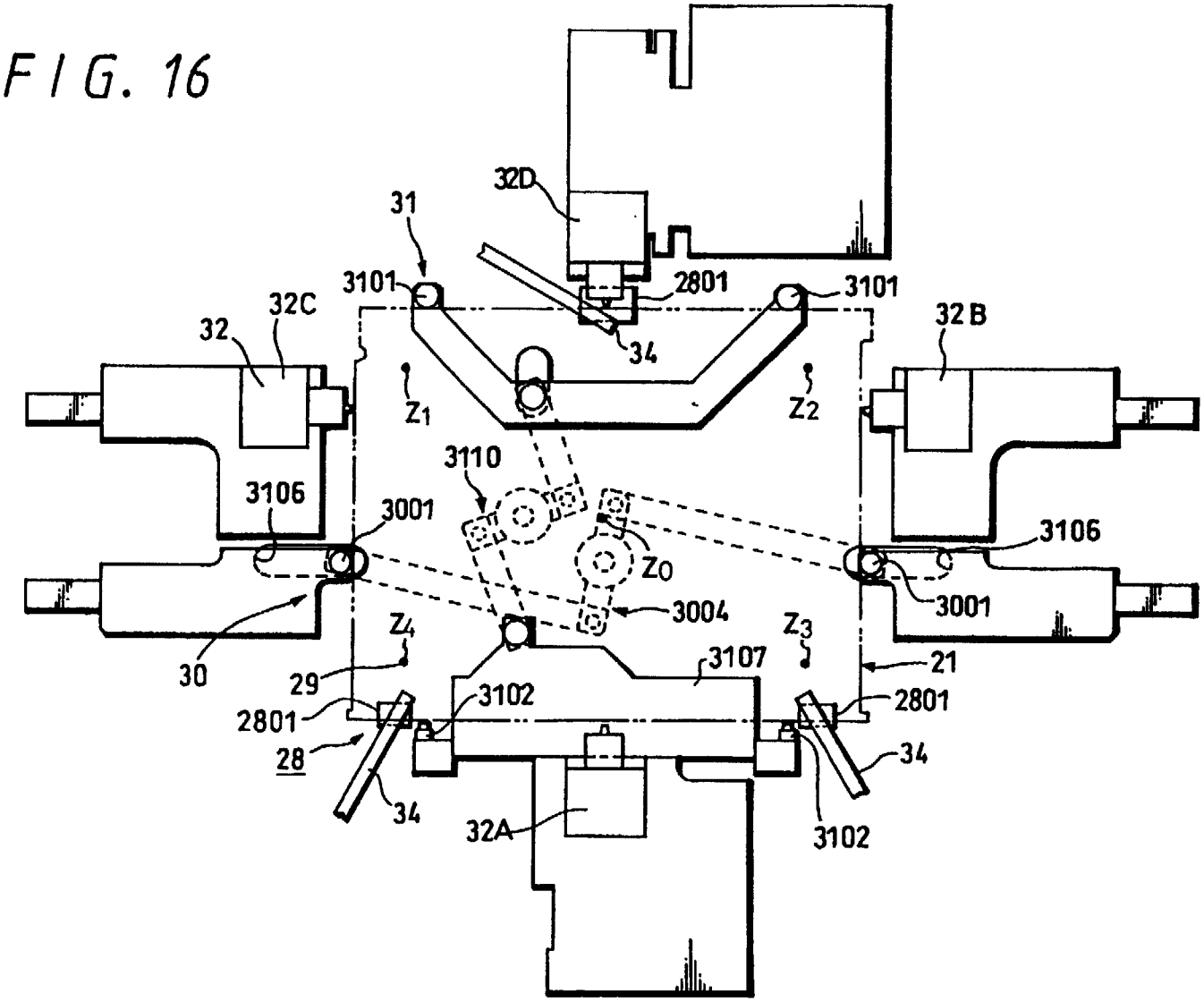
FIG. 16 is a plan view of a table of the welding apparatus according to another embodiment of the present invention.

FIGS. 14 and 15 are respectively a plan view and a front view of a welding apparatus according to this embodiment. FIG. 16 shows a plan view of a table provided in the welding apparatus. A welding apparatus 24 includes a base mount 25 having a long size in the left and right direction and a rectangular shape when it is seen from its top side, a table 26 which is movably disposed on the base mount 25 and to which the aperture grill 21 is delivered, an aperture-grill supporting means 28 provided on the table 26, a grill-position measuring means 29, left and right and upper and lower aperture-grill positioning means 30, 31, a spring positioning means 32, a spring welding means 33 for welding the springs 3 positioned by the spring positioning means 32 to the aperture grill 21, etc.

As shown in FIGS. 14 and 15, the table 26 is moved by a table drive means, not shown, provided on the base mount 25 in the left and right directions among a spring supply position 2501 located at a position to a left end of the base mount 25, a spring welding position 2503 to a right end of the base mount 25, and an aperture-grill delivery position 2505 located at the middle of both positions. At the aperture-grill supply position 2501, the springs 3 are supplied to the respective spring positioning means 32 on the table 26 from a spring supply portion. At the aperture-grill delivery position 2502, the aperture grill 21 is delivered onto the table 26 with a front surface of the grill 107 being faced toward the table 26.

Three aperture-grill supporting means 28 are provided. Each of the aperture-grill supporting means 28 includes a supporting body 2801 (a so-called bearer) supported by the table 26 so as to be capable of being lifted up and down. Each of the aperture-grill supporting means is arranged such that, in a state that the aperture grill 21 is delivered onto the table 26, the respective supporting bodies 2801 support the aperture grill at the front position, which is located at a substantial middle in the left and right direction, of the upper lateral member 103 and two front positions, which are located at an interval in the left and right direction, of the lower lateral member 103. Further, in correspondence with the respective supporting bodies 2801, there are provided press arms 34 for pressing the aperture grill 21 from positions above the upper and lower members 103 supported by the supporting bodies 2801, i.e., from rear surface positions to fix the aperture grill 21 at the positions (see FIGS. 16, 18 and 19).

The supporting bodies 2801 are lifted up and down by the lifting and driving units (not shown) provided between the table 26 and the supporting bodies 2801. The supporting bodies 2801 are lifted up and down by the lifting and driving units under the control of a control means, not shown, (e.g., a microcomputer) based on a measured result of the grill-position measuring means 29. In this embodiment, the lifting and driving unit and the control means form an aperture-grill posture adjusting means.

Figure 18:
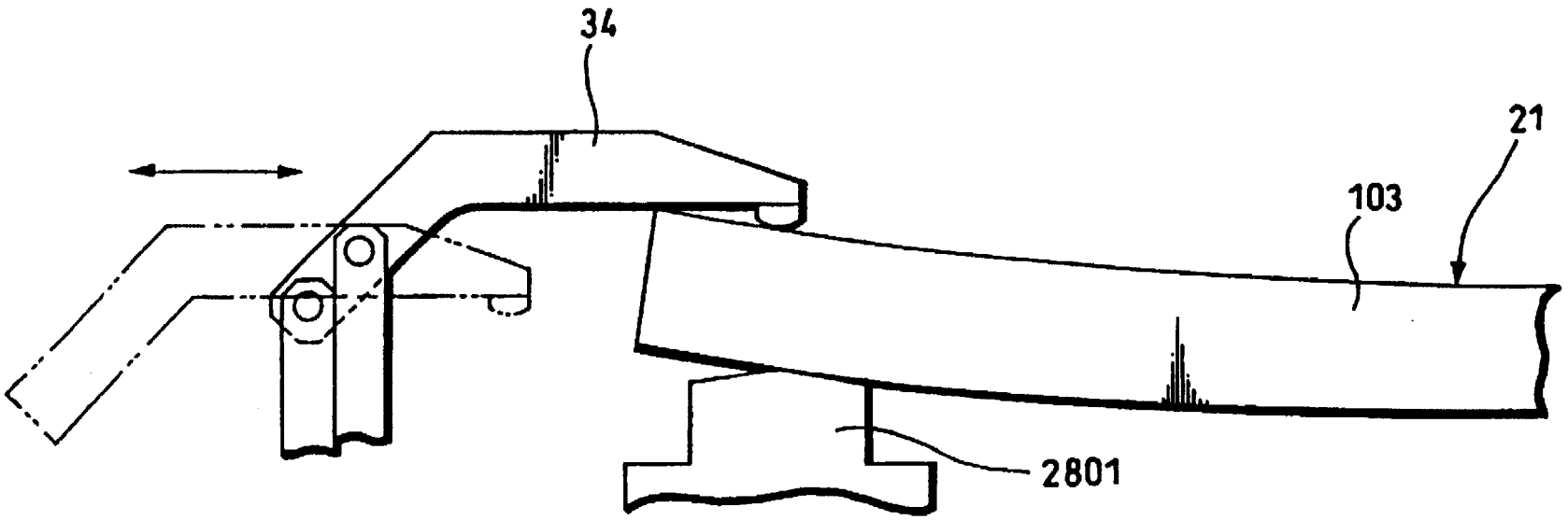
FIG. 18 is a side view of a main part of an aperture-grill supporting means of the welding apparatus according to another embodiment of the present invention.

As shown in FIG. 18, at a position shown by a chain line, the press arm 34 is brought away from the aperture grill 21 and brought in its standby state. At a position shown by a real line, the press arm presses the upper and lower lateral members 103.

As shown in FIG. 16, the five grill-position measuring means 29 are provided with corresponding to a measurement position $Z_0$ at a substantial center of the front of the grill 107 of the aperture grill 21 supported by the three supporting bodies 2801, and measurement positions $Z_1$ to $Z_4$ located to four-corner sides thereof. The grill-position measuring means 29 can employ an arrangement similar to that shown in FIG. 6, for example. The grill-position measuring means 29 are arranged such that respective measuring points 2901 thereof are brought in contact with the five measurement positions $Z_0$ to $Z_4$ of the grill 107 of the aperture grill 21 supported by the three supporting bodies 2801, thereby the positions of the measurement positions $Z_0$ to $Z_4$ being measured, and then the measured results are output to the above aperture-grill posture adjusting means.

Figure 17:
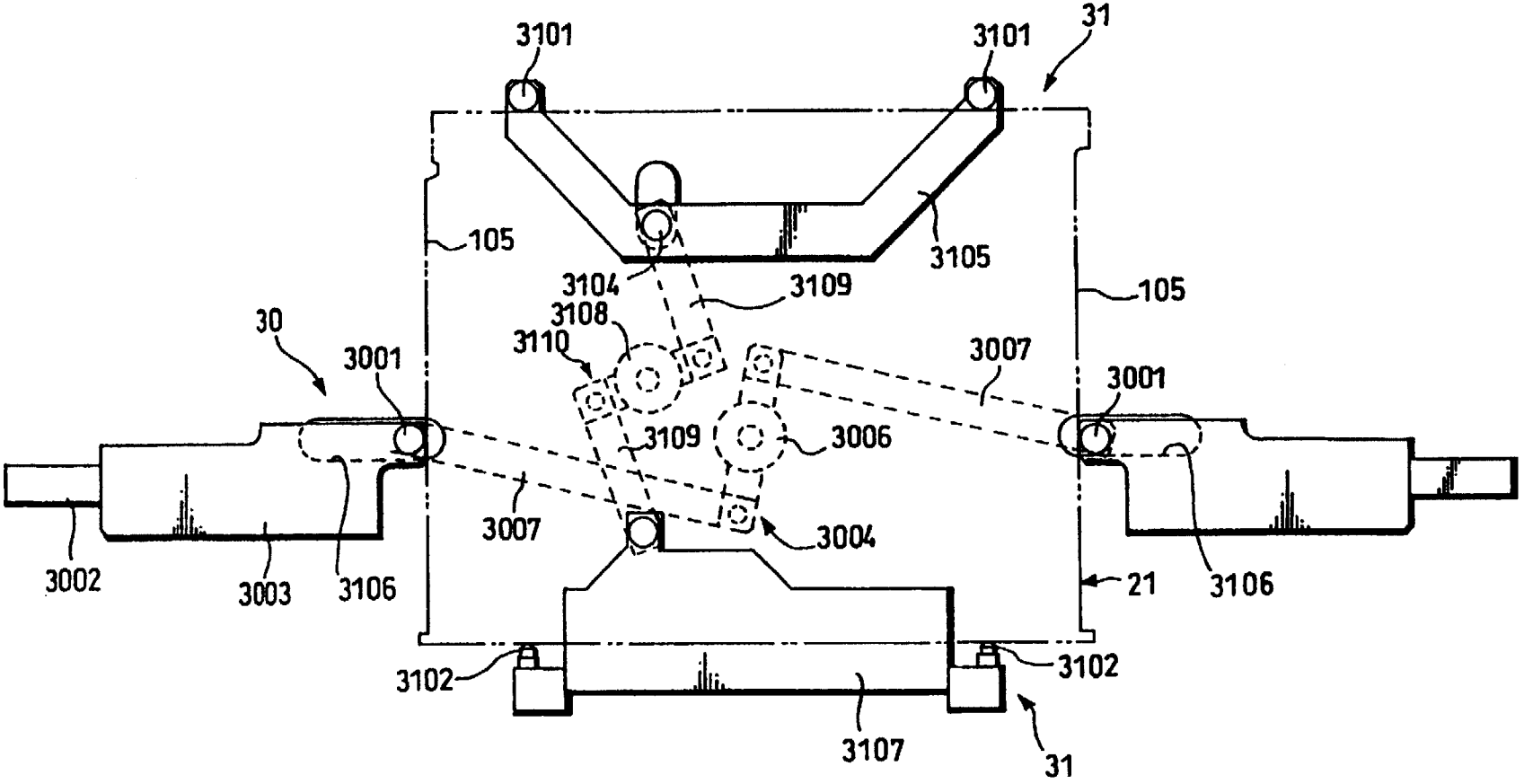
FIG. 17 is a plan view of an arrangement of an aperture-grill positioning means of the welding apparatus according to another embodiment of the present invention.

As shown in FIG. 16, the left and right aperture-grill positioning means 30 are respectively disposed on outer sides of the left and right longitudinal members 105, and the upper and lower aperture-grill positioning means 31 are respectively disposed on outer sides of the upper and lower lateral members 103. As shown in FIG. 17, each of the left and right aperture-grill positioning means 30 includes a positioning roller 3001 for being engaged with and released from each of substantially middle outer side surface positions of the left and right longitudinal members 105, and a slider 3003 which supports the roller 3001 and is movably supported by the table 26 through a guide rail 3002 in the left and right direction, i.e., the direction X. Each of the left and right aperture-grill positioning means is arranged such that a parting mechanism 3004 provided between both of the sliders 3003 and formed of a drive shaft 3006 and symmetrical links 3007 with respect to the left and right direction permits the left and right positioning rollers 3001 to be respectively engaged with and released from the left and right longitudinal members 105 of the aperture grill 21 in synchronization with each other.

As shown in FIG. 17, the respective upper and lower aperture-grill positioning means 31 include two positioning rollers 3101 for being engaged with and released from two outside positions, which are located at an interval in the left and right direction, of the upper lateral member 103, and two positioning contact members 3102 for being respectively engaged with and released from two outer side surface positions, which are located at an interval in the left and right direction, of the lower lateral member 103. The two lower positioning rollers 3101 are supported by left and right ends of a rocking arm 3105 which can be rocked around a supporting shaft 3104. The supporting shaft 3104 is engaged with a long aperture 3106 which is a guide extended in the upward and downward direction, i.e., the Y direction.

The two positioning contact members 3102 are supported on a common supporting plate 3107 disposed movably in the upward and downward direction (i.e., the Y direction). A parting mechanism 3110 formed of a drive shaft 3108 and links 3109 which are symmetrical in the upward and downward direction and provided between the rocking arm 3105 and the common supporting plate 3107 permits the positioning rollers 3101 and the positioning contact members 3102 to be engaged with and released from the upper and lower lateral members 103 in synchronization with each other. Even if the frame 101 is twisted, the rocking of the rocking arm 3105 allows the positioning rollers 3101 and the positioning contact members 3102 to be reliably engaged with the upper and lower lateral members 103, thereby the aperture grill 21 being able to be positioned.

Figure 19:
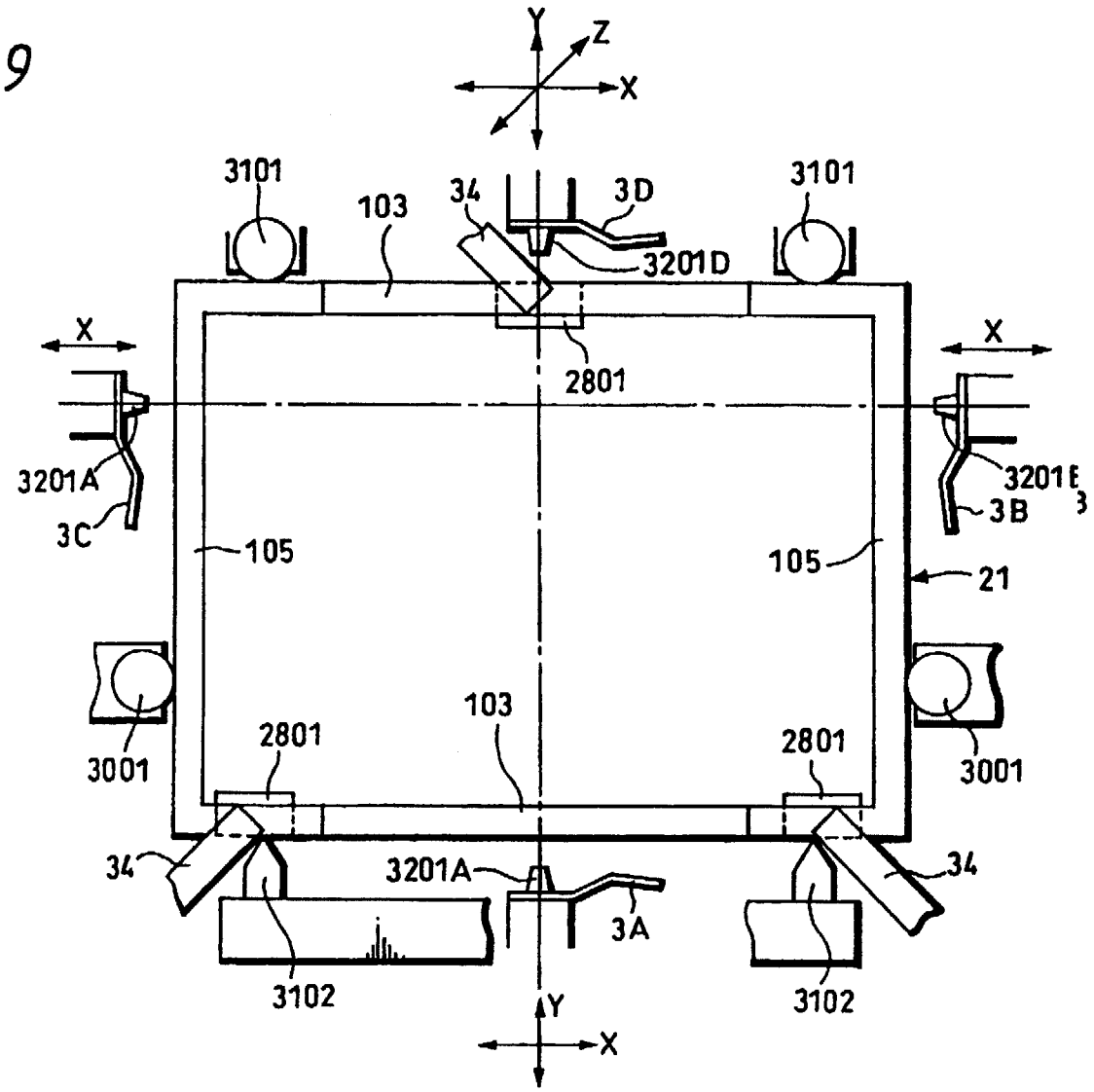
FIG. 19 is a diagram used to explain an operation of the welding apparatus according to another embodiment of the present invention.

The four spring positioning means 32 are provided. As shown in FIGS. 16 and 19, first, second, third and fourth spring positioning means 32A, 32B, 32C, 32D are respectively provided outside the upper and lower lateral members 103 and the left and right longitudinal members 105 of the aperture grill 21. As shown in FIGS. 14 and 15, each of the spring positioning means 32 [32A, 32B, 32C, 32D] is supported by the table 26.

The spring positioning means 32 [32A, 32B, 32C, 32D] respectively include holding members for holding the springs 3 [3A, 3B, 3C, 3D] similarly to the above-mentioned spring positioning means. Similarly to the above-mentioned holding members, the respective holding members include pins (so-called spring pins) 3201 [3201A, 3201B, 3201C, 3201D] which can be inserted into the pin apertures 307 of the springs 3 [3A, 3B, 3C, 3D], magnets for fitting outer surfaces of the head portions 305 of the springs 3 [3A, 3B, 3C, 3D] thereto with the spring pins 3201 being inserted into the pin apertures 307, and two projections for preventing the springs 3 from being rotated.

As shown in FIG. 19, the second and third spring positioning means 32B, 32C are arranged such that their spring pins 3201B, 3201C can be moved only in the left and right direction, i.e., in the X direction. The first spring positioning means 32A is arranged such that its spring pin 3201A can be moved in the left and right direction, i.e., the X direction and in the upward and downward direction, i.e., the Y direction. The fourth spring positioning means 32D is arranged such that its spring pin 3201D can be moved in the X direction, the Y direction, and the Z direction perpendicular to a plane of a sheet of the paper.

Each of the spring positioning means 32 [32A, 32B, 32C, 32D] can be moved in the direction in which it is moved closer to and away from the aperture grill 21.

As shown in FIGS. 14 and 15, the spring welding means 33 includes a supporting frame 36 provided at the right end of the base mount 25 so as to stand, and a welding machine 37 supported by the supporting frame 36 so as to be lifted up and down. The welding machine 37 includes four welding units 3701 [3701D, 3701A, 3701C, 3701B] respectively used for the upper lateral member 103, the lower lateral member 103, the left longitudinal member 105, and the right longitudinal member 105. Each of the welding units 3701A to 3701D includes two electrode portions disposed so as to be opposed to each other and so as to be moved close to and away from each other. In a state that the welding machine 33 is lifted down by the lifting and driving mechanism, the respective electrode portions are opposed to the inner surface of the spring holder 111 and the outer surface of the base portion 303 of the spring 3. The respective electrode portions are brought close to each other so as to be brought in contact with the spring holder 111 and the spring 3 and then energized, thereby the spring holder 111 and the spring 3 being welded by the spot welding.

It will be described to simultaneously weld the four springs 3 [3A, 3B, 3C, 3D] to the corresponding spring holders 111 by using the welding apparatus 24.

At first, at the spring supply position 2501, the springs 3 [3A, 3B, 3C, 3D] are respectively supplied to the spring pins 3201 [3201A, 3201B, 3201C, 3201D] of the spring positioning means 32 [32A, 32B, 32C, 32D] on the table 26 and then held.

Then, the table drive means moves the table 26 to the aperture-grill delivery position 2502, where the respective lifting and driving units of the aperture-grill supporting means 28 locate the head ends of the three supporting bodies 2801 at the reference positions whose heights from the table 26 are the same. In this state, the conveying means mounts the aperture grill 21 on the three supporting bodies 2801.

The aperture-grill positioning means 30 and 31 position the aperture grill 21 from the X direction and the Y direction with reference to the positions of the spring pins 3201B and 3201C of the second and third spring positioning means 32B and 32C, and then fixed by the press arms 34 with respect to the Z direction in the positioned state (see FIG. 19).

Figure 20:
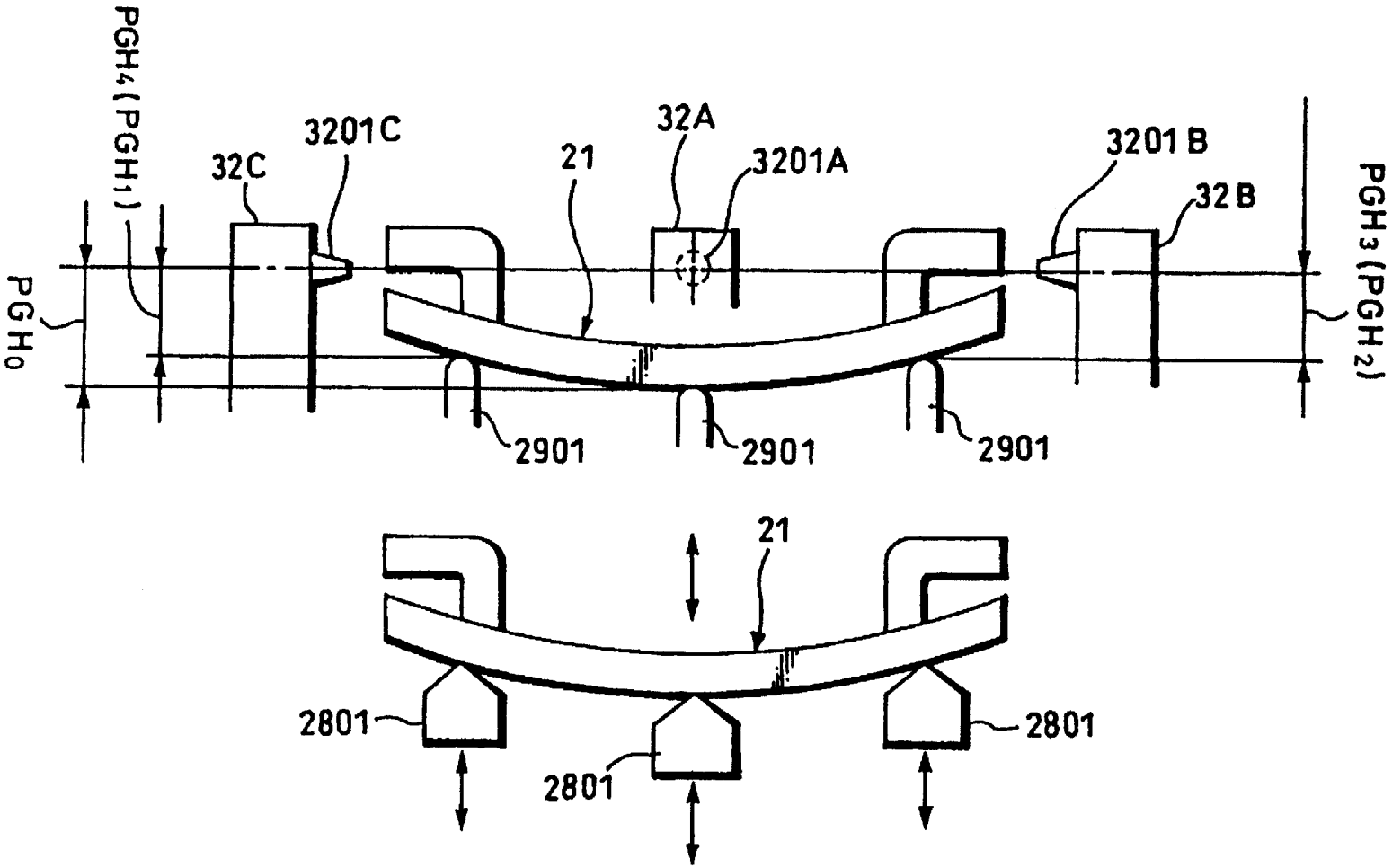
FIG. 20 is an explanatory diagram of measurement of a grill position and the supporting of the aperture grill of the welding apparatus according to another embodiment of the present invention.

Five measuring points 2901 of the grill-position measuring means 29 are respectively brought in contact with five measurement positions $Z_0$ to $Z_4$ of the grill 107 of the aperture grill 21, thereby measuring sizes PGH [$PGH_0$, $PGH_1$, $PGH_2$, $PGH_3$, $PGH_4$] from a reference plane 39 to the outer surfaces of the grill 107 which are determined by the first, second and third spring pins 3201A, 3201B and 3201C (see FIG. 20). Though not shown, when the panel 22 is positioned, sizes PPH [$PPH_0$, $PPH_1$, $PPH_2$, $PPH_3$, $PPH_4$] from the reference plane to the panel inner surface which are determined by the three panel pins 505A, 505B and 505C are similarly measured at measurement positions corresponding to the measurement positions $Z_0$ to $Z_4$ of the aperture grill 21. Based on these measured values PGH and PPH, the interval GH between the inner surface of the panel 22 and the grill 107 of the aperture grill 21 is measured (see FIG. 13).

The press arms 34, the respective positioning rollers 3001, 3101 of the aperture-grill positioning means 30 and 31, the positioning contact members 3102 thereof and so on are moved away from the aperture grill 21 to release the positioning of the aperture grill 21. Thereafter, under the control of the above-mentioned control means, the lifting and driving unit is operated to lift the three supporting bodies 2801 up and down and the posture of the aperture grill 21 is adjusted so that the interval GH should be set to the standard size. Specifically, the position of the aperture grill 21 in the Z direction is determined.

Thus, the interval GH (see FIG. 13) between the panel inner surface and the grill 107 of the aperture grill 21 is set and the interval GH marriage is finished. The aperture grill is positioned again by the aperture-grill positioning means 30 and 31 and the press arms 34.

Subsequently, a so-called engagement marriage which is the positioning of the springs 3 [3A, 3B, 3C, 3D] is carried out. The springs 3A to 3D are respectively positioned and held by the spring pins 3201A to 3201D. As shown in FIG. 12, the respective positions (ax, ay, bx, cx, dx, dy, dz) of the panel pins 505A to 505D are measured simultaneously with the measurement of the sizes PPH from the reference plane to the panel inner surface (see FIG. 13).

The second and third spring positioning means 32B, 32C are moved so that reference X-direction positions (BX, CX) of the second and third spring pins 3201B and 3201C should be agreed with X-direction positions (bx, cx) of the second and third panel pins 505B and 505C [BX=bx, CX=cx].

With reference to the positions of the second and third spring pins 3201B and 3201C, the first spring positioning means 32A is moved so that X- and Y-direction positions (AX, AY) of the first spring pin 3201A should be agreed with X- and Y-direction positions (ax, ay) of the first panel pins 505A.

Further, the fourth spring positioning means 32D is moved so that X-, Y- and Z-direction positions (DX, DY, DZ) of the fourth spring pin 3201D should be agreed with X-, Y- and Z-direction positions (dx, dy, dz) of the fourth panel pin 505D relative to the positions of the first, second and third spring pins 3201A, 3201B and 3201C.

Thus, relative positions of the panel pins 505 and the spring pins 3201 (accordingly the pin apertures of the springs engaged with the spring pins 3201 respectively) are agreed with each other and the engagement marriage is finished.

In this state, the respective base portions 303 of the springs 3A to 3D supported by the spring pins 3201A to 3201D are brought in contact with the corresponding spring holders 111. Upon the engagement marriage, since the first, second and third spring pins 3201A, 3201B and 3201C are prevented from being moved in the Z direction, the interval GH marriage is prevented from being changed.

The table drive means moves the table 26 to the spring welding position 2503, where the welding machine 37 of the spring welding means 33 is lifted down. The four welding units 3701A to 3701D simultaneously weld the base portions 303 of the springs 3A to 3D to the spring holders 111, respectively.

After welding the springs, the welding machine 37 is lifted up. The table drive means moves the table 26 to the aperture-grill delivery position 2502. The spring positioning means 32A to 32D are moved in the direction in which they are moved away from the aperture grill 21, thereby the spring pins 3201A to 3201D being pulled out of the pin apertures 307 of the springs 3A to 3D. The press arms 34 and the spring positioning means 30 and 31 are moved away from the aperture grill 21 to release the positioning of the aperture grill 21. Then, the conveying means conveys the aperture grill 21 from the table 26.

According to this embodiment, when the four springs 3A to 3D are welded to the aperture grill 21 in the case of a high-definition CRT, for example, it is possible to weld the four springs 3A to 3D to the four positions of the upper and lower lateral members 103 and the left and right longitudinal members 105 simultaneously. Therefore, an error in the positioning of the aperture grill 21 and the springs 3A to 3D is reduced, which can improve quality of the CRT.

According to this embodiment, since the so-called interval GH marriage for setting the interval GH between the aperture grill and the panel and the so-called engagement marriage for agreeing the pin aperture positions of the four springs with the four panel pin positions of the panel are carried out on the same table, the welding which has been carried out in two processes is completed only in one process, which improves the working property. An equipment for the interval GH marriage and an equipment for the engagement marriage are made integral, which can improve efficiency in a space of the equipment.

The embodiment for simultaneously welding the four springs, similarly to the above embodiment for simultaneously welding the three springs, can be modified. For example, the positions of the aperture grill 21 supported by the three supporting bodies 2801 are not limited to the positions described in the embodiment. The aperture grill 21 may be supported by, for example, an arrangement in which the aperture grill is supported with the rear surface of the grill 107 being faced toward the table 26. The number of the grill-position measuring means 29 and the measurement positions are not limited to that described in the embodiment and hence may be selected optionally. Further, it may be optionally selected which of the aperture grill 21 and the springs 3 are supplied onto the table 26 first.

We claim:

1. A method of welding a spring to an aperture grill, wherein panel attachment springs are welded to at least three side portions of four side portions of a substantially rectangular aperture grill having a color selection grill, said method comprising disposing said aperture grill so that said selection grill is opposed to a predetermined reference plane;

disposing said springs at positions opposed to said at least three side portions outside said aperture grill on a plane substantially parallel to said reference plane;

measuring a plurality of measurement positions of said selection grill relative to said reference plane;

adjusting a posture of said aperture grill based on measured results of the respective measurement positions of said selection grill so that said respective measurement positions is located at reference positions relative to said reference plane;

after a posture of said aperture grill is adjusted, moving said springs close to said aperture grill on a plane parallel to said reference plane; and contacting and welding said springs in contact with and to said at least three side portions.

2. A method of welding a spring to an aperture grill according to claim 1, characterized in that three supporting bodies respectively support one side portion of a pair of said side portions opposed to each other at a middle side-portion position in the extended direction of said side portion and the other side portion at two side-portion positions located at an interval in the extended direction of said side portion and said respective supporting bodies are moved close to one said side portion and away from the other said side portion, thereby the posture of said aperture grill being adjusted.

3. A method of welding a spring to an aperture grill according to claim 1, characterized in that measurement of positions of a plurality of measurement positions of said selection grill with respect to said reference plane and the welding of said springs to said at least three side portions are respectively carried out at positions located at an interval along said reference plane.

4. A spring welding apparatus for welding panel attachment springs to at least three side portions of a substantially rectangular aperture grill having a color selection grill a table;

an aperture-grill supporting means for supporting said aperture grill on said table so that a posture of the former can be adjusted;

a grill-position measuring means for measuring a plurality of measurement positions of said selection grill in a state that said aperture-grill supporting means supports said aperture grill;

an aperture-grill posture adjusting means for driving said aperture-grill supporting means based on measurement obtained by said grill-position measuring means and for adjusting the posture of said aperture grill so that the plurality of measurement positions of said selection grill should be located at respective predetermined positions;

an aperture-grill positioning means for positioning on said table said aperture grill adjusted in posture by said aperture-grill posture adjusting means;

a spring positioning means disposed at positions opposed to said at least three side portions of said aperture grill positioned by said aperture-grill positioning means, for bringing said springs in contact with said at least three side portions to position the former; and a spring welding means for welding the springs positioned by said spring positioning means to the side portions of said aperture grill positioned by said aperture-grill positioning means.

5. A spring welding apparatus according to claim 4, wherein said aperture-grill supporting means comprises three supporting bodies for respectively supporting one side portion of said side portions, which are provided in said table so that they can be lifted up and down and which are opposed to each other, at a middle side-portion position in the extended direction of said side portion and the other side portion at two side-portion positions located at an interval in the extended direction of said side portion, and said aperture-grill posture adjusting means comprises a lifting and driving source for lifting said respective bodies up and down.

6. A spring welding apparatus according to claim 4, wherein said aperture-grill supporting means, said grill-position measuring means, said aperture-grill posture adjusting means, said aperture-grill positioning means, and said spring positioning means are provided in said table.

7. A spring welding apparatus according to claim 4, further comprising a spring supplying means for supplying springs to said respective spring positioning means.

8. A spring welding apparatus according to claim 7, further comprising a base mount for movably supporting said table and a table drive means for moving said table on said base mount, wherein measurement of positions of the plurality of measurement positions of said selection grill by said grill-position measuring means, supply of springs to said respective spring positioning means by said spring supplying means, and the welding of said springs to said aperture grill by said spring welding means are carried out in a state that said table is moved to different positions on said base mount.

9. A spring welding apparatus according to claim 4, wherein the side portion of said aperture grill comprises four upper, lower, left and right members, spring holders are attached to at least three members of said four members, and said spring welding means welds said springs to said spring holders.

10. A method of welding a spring to an aperture grill, wherein panel attachment springs are welded to four side portions of a substantially rectangular aperture grill having a color selection grill, said method comprising:

disposing said springs at first, second, third, and fourth spring pins with four spring positioning means for positioning said springs;

disposing said aperture grill so that said selection grill is opposed to a reference plane determined by the spring pins of three spring positioning means of said four spring positioning means;

measuring a plurality of measurement positions of said selection grill relative to said reference plane;

adjusting a posture of said aperture grill based on the respective measurement positions of said selection grill so that said respective measurement positions are located at predetermined reference positions relative to said reference plane;

matching positions of the respective spring pins of said four spring positioning means with positions of panel pins provided on four side portions of a panel of a cathode-ray tube; and welding said four springs to the four side portions of said aperture grill simultaneously.

11. A method of welding a spring to an aperture grill according to claim 10, wherein the second and third spring pins are opposed to each other in a first direction and are moved so that first-direction positions of said second and third spring pins are matched with positions of corresponding second and third panel pins, opposed to each other in the first direction of said panel pins, the first spring pin, which is one of spring pins opposed to each other in the second direction perpendicular to the first direction, is moved so that the first-direction position and second-direction position of said first spring pin are matched with a position of a first panel pin which is one of panel pins opposed to each other in the second direction, and a fourth spring pin in the second direction is moved so that first-, second-, and third-direction positions, which are perpendicular to one another, of said fourth spring pin are matched with a position of a fourth panel pin.

12. A spring welding apparatus for welding panel attachment springs to four side portions of a substantially rectangular aperture grill having a color selection grill a table;

an aperture-grill supporting means for supporting said aperture grill on said table at at least three positions so that a posture of the former can be adjusted;

a grill-position measuring means for measuring of a plurality of measurement positions of said selection grill in a state that said aperture-grill supporting means supports said aperture grill;

an aperture-grill posture adjusting means for adjusting said aperture-grill supporting means based on measurements obtained by said grill-position measuring means and for adjusting a posture of said aperture grill so that a plurality of measurement positions of said selection grill are located at corresponding predetermined positions;

an aperture-grill positioning means for positioning on said table said aperture grill at a posture adjusted by said aperture-grill posture adjusting means;

first, second, third and fourth spring positioning means disposed at positions opposed to the four side portions of said aperture grill positioned by said aperture-grill positioning means, for contacting said springs with said four side portions; and a spring welding means for welding the springs positioned by said spring positioning means to the side portions wherein of said four spring positioning means, said second and third spring positioning means are opposed to each other in a first direction and can be moved and adjusted in the first direction, a first spring positioning means in a second direction perpendicular to the first direction can be moved and adjusted in the first and second directions, and said fourth spring positioning means in the second direction can be moved and adjusted in the first, second and third directions.

* * * * *